US011376489B2

(12) United States Patent
Scheper et al.

(10) Patent No.: US 11,376,489 B2
(45) Date of Patent: Jul. 5, 2022

(54) CARD-HANDLING DEVICES AND RELATED METHODS, ASSEMBLIES, AND COMPONENTS

(71) Applicant: SG Gaming, Inc., Las Vegas, NV (US)

(72) Inventors: Paul K. Scheper, Bloomington, MN (US); Colin A. Helsen, Arundel (AU); Ronald R. Swanson, Otsego, MN (US); Peter Krenn, Neufeld (AT)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/457,357

(22) Filed: Jun. 28, 2019

(65) Prior Publication Data

US 2020/0086204 A1 Mar. 19, 2020

Related U.S. Application Data

(63) Continuation-in-part of application No. 16/132,090, filed on Sep. 14, 2018, and a continuation-in-part of application No. PCT/US2019/027460, filed on Apr. 15, 2019.

(51) Int. Cl.

| | |
|---|---|
| ***A63F 1/12*** | (2006.01) |
| ***A63F 1/14*** | (2006.01) |
| ***A63F 1/10*** | (2006.01) |

(52) U.S. Cl.

CPC ..... *A63F 1/12* (2013.01); *A63F 1/10* (2013.01); *A63F 1/14* (2013.01)

(58) Field of Classification Search

CPC ..... A63F 1/12; A63F 1/14; A63F 1/10

See application file for complete search history.

(56) References Cited

U.S. PATENT DOCUMENTS

| | | | |
|---|---|---|---|
| 130,281 | A | 8/1872 | Coughlin |
| 205,030 | A | 6/1878 | Ash |
| 609,730 | A | 8/1898 | Booth |
| 673,154 | A | 4/1901 | Bellows |
| 793,489 | A | 6/1905 | Caleb |
| 892,389 | A | 7/1908 | Bellows |

(Continued)

FOREIGN PATENT DOCUMENTS

| | | | |
|---|---|---|---|
| AU | 2383667 | A | 1/1969 |
| AU | 5025479 | A | 3/1980 |

(Continued)

OTHER PUBLICATIONS

"Error Back propagation," http://willamette.edu~gorr/classes/cs449/backprop.html(4 pages), Nov. 13, 2008.

(Continued)

*Primary Examiner* — Eugene L Kim
*Assistant Examiner* — Christopher Glenn
(74) *Attorney, Agent, or Firm* — TraskBritt

(57) ABSTRACT

A card-handling device and related methods may include a card intake, a card rotation device, and a card output. The card rotation device may be configured to rotate at least one of the one or more playing cards about a minor axis of the one or more playing cards to randomly alter an orientation of lateral edges of the one or more playing cards. A card-handling device and related methods may be configured to recognize unreadable cards and move the unreadable cards to a designated position.

20 Claims, 17 Drawing Sheets

(56) References Cited

U.S. PATENT DOCUMENTS 1,014,219 A 1/1912 Hall
1,043,109 A 11/1912 Horace
1,157,898 A 10/1915 Perret
1,256,509 A 2/1918 Belknap
1,380,898 A 6/1921 Hall
1,556,856 A 10/1925 Lipps
1,757,553 A 5/1930 Tauschek
1,850,114 A 3/1932 McCaddin
1,885,276 A * 11/1932 McKay ..... A63F 1/12
273/149 R
1,889,729 A 11/1932 Hammond
1,955,926 A 4/1934 Matthaey
1,992,085 A 2/1935 McKay
1,998,690 A 4/1935 William et al.
2,001,220 A 5/1935 Smith
2,001,918 A 5/1935 Nevius
2,016,030 A 10/1935 Woodruff et al.
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,328,153 A 8/1943 Laing
2,328,879 A 9/1943 Issacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Earl et al.
2,714,510 A 8/1955 Oppenlander et al.
2,717,782 A 9/1955 Droll
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,914,215 A 11/1959 Neidig
2,937,739 A 5/1960 Maurice
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Hjalmar
D200,652 S 3/1965 Fisk
3,222,071 A 12/1965 Lang
3,235,741 A 2/1966 Plaisance
3,288,308 A 11/1966 Gingher
3,305,237 A 2/1967 Granius
3,312,473 A 4/1967 Friedman et al.
3,452,509 A 7/1969 Werner
3,530,968 A 9/1970 Palmer
3,588,116 A 6/1971 Kosaburo
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Erickson
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure
3,810,627 A 5/1974 Levy
D232,953 S 9/1974 Shigeo
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Kurokawa et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheffer
D273,962 S 5/1984 Fromm
D274,069 S 5/1984 Fromm
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg
4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.

(56) References Cited

U.S. PATENT DOCUMENTS 4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 Levasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 Lestrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson et al.
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.

(56) References Cited

U.S. PATENT DOCUMENTS

| | | | |
|---|---|---|---|
| 6,234,900 | B1 | 5/2001 | Cumbers |
| 6,236,223 | B1 | 5/2001 | Brady et al. |
| 6,250,632 | B1 | 6/2001 | Albrecht |
| 6,254,002 | B1 | 7/2001 | Litman |
| 6,254,096 | B1 | 7/2001 | Grauzer et al. |
| 6,254,484 | B1 | 7/2001 | McCrea, Jr. |
| 6,257,981 | B1 | 7/2001 | Acres et al. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,272,223 | B1 | 8/2001 | Carlson |
| 6,293,546 | B1 | 9/2001 | Hessing et al. |
| 6,293,864 | B1 | 9/2001 | Romero |
| 6,299,167 | B1 | 10/2001 | Sines et al. |
| 6,299,534 | B1 | 10/2001 | Breeding et al. |
| 6,299,536 | B1 | 10/2001 | Hill |
| 6,308,886 | B1 | 10/2001 | Benson et al. |
| 6,313,871 | B1 | 11/2001 | Schubert |
| 6,325,373 | B1 | 12/2001 | Breeding et al. |
| 6,334,614 | B1 | 1/2002 | Breeding |
| 6,341,778 | B1 | 1/2002 | Lee |
| 6,342,830 | B1 | 1/2002 | Want et al. |
| 6,346,044 | B1 | 2/2002 | McCrea, Jr. |
| 6,361,044 | B1 | 3/2002 | Block et al. |
| 6,386,973 | B1 | 5/2002 | Yoseloff |
| 6,402,142 | B1 | 6/2002 | Warren et al. |
| 6,446,864 | B1 | 9/2002 | Kim et al. |
| 6,454,266 | B1 | 9/2002 | Breeding et al. |
| 6,460,848 | B1 | 10/2002 | Soltys et al. |
| 6,464,584 | B2 | 10/2002 | Oliver |
| 6,490,277 | B1 | 12/2002 | Tzotzkov |
| 6,508,709 | B1 | 1/2003 | Karmarkar |
| 6,514,140 | B1 | 2/2003 | Storch |
| 6,517,435 | B2 | 2/2003 | Soltys et al. |
| 6,517,436 | B2 | 2/2003 | Soltys et al. |
| 6,527,271 | B2 | 3/2003 | Soltys et al. |
| 6,530,836 | B2 | 3/2003 | Soltys et al. |
| 6,532,297 | B1 | 3/2003 | Lindquist |
| 6,533,276 | B2 | 3/2003 | Soltys et al. |
| 6,533,662 | B2 | 3/2003 | Soltys et al. |
| 6,543,770 | B1 | 4/2003 | Kaji et al. |
| 6,561,897 | B1 | 5/2003 | Bourbour et al. |
| 6,579,180 | B2 | 6/2003 | Soltys et al. |
| 6,579,181 | B2 | 6/2003 | Soltys et al. |
| 6,581,747 | B1 | 6/2003 | Charlier et al. |
| 6,582,301 | B2 | 6/2003 | Hill |
| 6,582,302 | B2 | 6/2003 | Romero |
| 6,585,586 | B1 | 7/2003 | Romero |
| 6,585,588 | B2 | 7/2003 | Hartl |
| 6,585,856 | B2 | 7/2003 | Zwick et al. |
| 6,588,750 | B1 | 7/2003 | Grauzer et al. |
| 6,588,751 | B1 | 7/2003 | Grauzer et al. |
| 6,595,857 | B2 | 7/2003 | Soltys et al. |
| 6,609,710 | B1 | 8/2003 | Order |
| 6,612,928 | B1 | 9/2003 | Bradford et al. |
| 6,616,535 | B1 | 9/2003 | Nishizaki et al. |
| 6,619,662 | B2 | 9/2003 | Miller |
| 6,622,185 | B1 | 9/2003 | Johnson et al. |
| 6,626,757 | B2 | 9/2003 | Oliveras |
| 6,629,019 | B2 | 9/2003 | Legge et al. |
| 6,629,591 | B1 | 10/2003 | Griswold et al. |
| 6,629,889 | B2 | 10/2003 | Mothwurf |
| 6,629,894 | B1 | 10/2003 | Purton |
| 6,637,622 | B1 | 10/2003 | Robinson |
| 6,645,068 | B1 | 11/2003 | Kelly et al. |
| 6,645,077 | B2 | 11/2003 | Rowe |
| 6,651,981 | B2 | 11/2003 | Grauzer et al. |
| 6,651,985 | B2 | 11/2003 | Sines et al. |
| 6,652,379 | B2 | 11/2003 | Soltys et al. |
| 6,655,690 | B1 | 12/2003 | Oskwarek |
| 6,658,135 | B1 | 12/2003 | Morito et al. |
| 6,659,460 | B2 | 12/2003 | Blaha et al. |
| 6,659,461 | B2 | 12/2003 | Yoseloff et al. |
| 6,659,875 | B2 | 12/2003 | Purton |
| 6,663,490 | B2 | 12/2003 | Soltys et al. |
| 6,666,768 | B1 | 12/2003 | Akers |
| 6,671,358 | B1 | 12/2003 | Seidman et al. |
| 6,676,517 | B2 | 1/2004 | Beavers |
| 6,680,843 | B2 | 1/2004 | Farrow et al. |
| 6,685,564 | B2 | 2/2004 | Oliver |
| 6,685,567 | B2 | 2/2004 | Cockerille et al. |
| 6,685,568 | B2 | 2/2004 | Soltys et al. |
| 6,688,597 | B2 | 2/2004 | Jones |
| 6,688,979 | B2 | 2/2004 | Soltys et al. |
| 6,690,673 | B1 | 2/2004 | Jarvis |
| 6,698,756 | B1 | 3/2004 | Baker et al. |
| 6,698,759 | B2 | 3/2004 | Webb et al. |
| 6,702,289 | B1 | 3/2004 | Feola |
| 6,702,290 | B2 | 3/2004 | Buono-Correa et al. |
| 6,709,333 | B1 | 3/2004 | Bradford et al. |
| 6,719,634 | B2 | 4/2004 | Mishina et al. |
| 6,722,974 | B2 | 4/2004 | Sines et al. |
| 6,726,205 | B1 | 4/2004 | Purton |
| 6,732,067 | B1 | 5/2004 | Powderly |
| 6,733,012 | B2 | 5/2004 | Bui et al. |
| 6,733,388 | B2 | 5/2004 | Mothwurf |
| 6,746,333 | B1 | 6/2004 | Onda et al. |
| 6,747,560 | B2 | 6/2004 | Stevens, III |
| 6,758,751 | B2 | 7/2004 | Soltys et al. |
| 6,758,757 | B2 | 7/2004 | Luciano et al. |
| 6,769,693 | B2 | 8/2004 | Huard et al. |
| 6,774,782 | B2 | 8/2004 | Runyon et al. |
| 6,789,801 | B2 | 9/2004 | Snow |
| 6,802,510 | B1 | 10/2004 | Haber |
| 6,804,763 | B1 | 10/2004 | Stockdale et al. |
| 6,808,173 | B2 | 10/2004 | Snow |
| 6,827,282 | B2 | 12/2004 | Silverbrook |
| 6,834,251 | B1 | 12/2004 | Fletcher |
| 6,840,517 | B2 | 1/2005 | Snow et al. |
| 6,842,263 | B1 | 1/2005 | Saeki |
| 6,843,725 | B2 | 1/2005 | Nelson |
| 6,848,616 | B2 | 2/2005 | Tsirline et al. |
| 6,848,844 | B2 | 2/2005 | McCue et al. |
| 6,848,994 | B1 | 2/2005 | Knust et al. |
| 6,857,961 | B2 | 2/2005 | Soltys et al. |
| 6,874,784 | B1 | 4/2005 | Promutico et al. |
| 6,874,786 | B2 | 4/2005 | Bruno et al. |
| 6,877,657 | B2 | 4/2005 | Ranard et al. |
| 6,877,748 | B1 | 4/2005 | Patroni et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fischer et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes et al. |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,066,464 | B2 | 6/2006 | Blad et al. |
| 7,068,822 | B2 | 6/2006 | Scott |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,128,652 | B1 | 10/2006 | Lavoie et al. |
| 7,139,108 | B2 | 11/2006 | Andersen et al. |

(56) References Cited

U.S. PATENT DOCUMENTS

| | | | |
|---|---|---|---|
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,642 | B2 | 8/2007 | Sines et al. |
| 7,257,630 | B2 | 8/2007 | Cole et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Koseloff et al. |
| 7,367,565 | B2 | 5/2008 | Chiu |
| 7,367,884 | B2 | 5/2008 | Breeding et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,399,226 | B2 | 7/2008 | Mishra |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,525,510 | B2 | 4/2009 | Beland et al. |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,575,237 | B2 | 8/2009 | Snow |
| 7,578,506 | B2 | 8/2009 | Lambert |
| 7,584,963 | B2 | 9/2009 | Krenn et al. |
| 7,584,966 | B2 | 9/2009 | Snow |
| 7,591,728 | B2 | 9/2009 | Gioia et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,853 | B2 | 3/2010 | Jones |
| 7,686,681 | B2 | 3/2010 | Soltys et al. |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,758,425 | B2 | 7/2010 | Poh et al. |
| 7,762,554 | B2 | 7/2010 | Ho |
| 7,766,333 | B1 | 8/2010 | Stardust et al. |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,824,255 | B2 | 11/2010 | Lutnick et al. |
| 7,846,020 | B2 | 12/2010 | Walker et al. |
| 7,874,559 | B1 | 1/2011 | Tseng |
| 7,890,365 | B2 | 2/2011 | Hettinger |
| 7,900,923 | B2 | 3/2011 | Toyama et al. |
| 7,908,169 | B2 | 3/2011 | Hettinger |
| 7,931,533 | B2 | 4/2011 | Lemay et al. |
| 7,946,586 | B2 | 5/2011 | Krenn et al. |
| 7,959,153 | B2 | 6/2011 | Franks, Jr. |
| 7,976,023 | B1 | 7/2011 | Messing et al. |
| 7,988,554 | B2 | 8/2011 | Lemay et al. |
| 7,995,196 | B1 | 8/2011 | Fraser |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |
| 8,092,307 | B2 | 1/2012 | Kelly |
| 8,109,514 | B2 | 2/2012 | Toyama |
| 8,150,158 | B2 | 4/2012 | Downs, III |
| 8,171,567 | B1 | 5/2012 | Fraser et al. |
| 8,210,536 | B2 | 7/2012 | Blaha et al. |
| 8,251,293 | B2 | 8/2012 | Nagata et al. |
| 8,251,802 | B2 | 8/2012 | Snow |
| 8,270,603 | B1 | 9/2012 | Durst et al. |
| 8,287,347 | B2 | 10/2012 | Snow et al. |
| 8,287,386 | B2 | 10/2012 | Miller et al. |
| 8,319,666 | B2 | 11/2012 | Weinmann et al. |
| 8,342,525 | B2 | 1/2013 | Scheper et al. |
| 8,342,526 | B1 | 1/2013 | Sampson et al. |
| 8,342,529 | B2 | 1/2013 | Snow |
| 8,353,513 | B2 | 1/2013 | Swanson |
| 8,419,521 | B2 | 4/2013 | Grauzer et al. |
| 8,429,229 | B2 | 4/2013 | Sepich et al. |
| 8,444,489 | B2 | 5/2013 | Lian et al. |
| 8,475,252 | B2 | 7/2013 | Savage et al. |
| 8,485,527 | B2 | 7/2013 | Sampson et al. |
| 8,498,444 | B2 | 7/2013 | Sharma |
| 8,505,916 | B2 | 8/2013 | Grauzer et al. |
| 8,511,684 | B2 | 8/2013 | Grauzer et al. |
| 8,512,146 | B2 | 8/2013 | Gururajan et al. |
| 8,550,464 | B2 | 10/2013 | Soltys et al. |
| 8,556,263 | B2 | 10/2013 | Grauzer et al. |
| 8,579,289 | B2 | 11/2013 | Rynda et al. |
| 8,590,895 | B2 | 11/2013 | Kwon |
| RE44,616 | E | 12/2013 | Blaha et al. |
| 8,602,416 | B2 | 12/2013 | Toyama |
| 8,616,552 | B2 | 12/2013 | Czyzewski et al. |
| 8,651,485 | B2 | 2/2014 | Stasson |
| 8,662,500 | B2 | 3/2014 | Swanson |
| 8,695,978 | B1 | 4/2014 | Ho |
| 8,702,100 | B2 | 4/2014 | Snow et al. |
| 8,702,101 | B2 | 4/2014 | Scheper et al. |
| 8,720,891 | B2 | 5/2014 | Hessing et al. |
| 8,758,111 | B2 | 6/2014 | Lutnick |
| 8,777,727 | B2 | 7/2014 | Jones |
| 8,820,745 | B2 | 9/2014 | Grauzer et al. |

(56) References Cited

U.S. PATENT DOCUMENTS 8,899,587 B2 12/2014 Grauzer et al.
8,919,775 B2 12/2014 Wadds et al.
8,998,211 B2 4/2015 Grauzer et al.
9,101,821 B2 8/2015 Snow
9,251,661 B2 2/2016 Tammesoo
9,254,435 B2 2/2016 Miller et al.
9,266,012 B2 2/2016 Grauzer et al.
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,573,047 B1 2/2017 Riordan et al.
9,679,603 B2 6/2017 Kelly et al.
9,731,190 B2 8/2017 Sampson et al.
10,022,617 B2 7/2018 Stasson et al.
10,092,820 B2 10/2018 Riordan et al.
10,124,241 B2 11/2018 Stasson et al.
10,857,448 B2 12/2020 Kelly et al.
2001/0035604 A1 11/2001 Jones
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer et al.
2003/0048476 A1 3/2003 Yamakawa
2003/0052449 A1 3/2003 Grauzer et al.
2003/0052450 A1* 3/2003 Grauzer ..... A63F 1/06 273/149 R
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0087694 A1 5/2003 Storch
2003/0090059 A1 5/2003 Grauzer et al.
2003/0094756 A1 5/2003 Grauzer et al.
2003/0151194 A1 8/2003 Messing et al.
2003/0195025 A1 10/2003 Hill
2004/0015423 A1 1/2004 Walker et al.
2004/0067789 A1* 4/2004 Grauzer ..... A63F 1/12 463/11
2004/0100026 A1 5/2004 Haggard
2004/0108255 A1 6/2004 Johnson
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0026680 A1 2/2005 Gururajan
2005/0035548 A1 2/2005 Yoseloff et al.
2005/0037843 A1 2/2005 Wells et al.
2005/0040594 A1* 2/2005 Krenn ..... A63F 1/12 273/149 R
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0140090 A1 6/2005 Breeding et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs, III
2005/0272501 A1 12/2005 Tran et al.
2005/0277463 A1 12/2005 Knust et al.
2005/0288083 A1 12/2005 Downs, III
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0063577 A1 3/2006 Downs et al.
2006/0066048 A1 3/2006 Krenn et al.
2006/0084502 A1 4/2006 Downs et al.
2006/0151946 A1 7/2006 Ngai
2006/0157930 A1* 7/2006 Shai ..... A63F 1/12 273/149 R
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1* 10/2006 Baker ..... A63F 1/12 273/149 R
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2007/0001395 A1 1/2007 Gioia et al.
2007/0006708 A1 1/2007 Laakso
2007/0015583 A1 1/2007 Tran
2007/0018389 A1 1/2007 Downs, III
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0102879 A1 5/2007 Stasson
2007/0111773 A1 5/2007 Gururajan et al.
2007/0148283 A1 6/2007 Harvey et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1* 9/2007 Blaha ..... A63F 1/12 273/149 R
2007/0225055 A1 9/2007 Weisman
2007/0233567 A1 10/2007 Daly
2007/0238506 A1 10/2007 Ruckle
2007/0241498 A1* 10/2007 Soltys ..... A63F 1/16 273/149 R
2007/0259709 A1 11/2007 Kelly et al.
2007/0267812 A1 11/2007 Grauzer et al.
2007/0272600 A1 11/2007 Johnson
2007/0273094 A1* 11/2007 Fleckenstein ..... A63F 1/14 273/149 P

(56) References Cited

U.S. PATENT DOCUMENTS

2007/0287534 A1 12/2007 Fleckenstein
2007/0290438 A1 12/2007 Grauzer et al.
2007/0298865 A1* 12/2007 Soltys ..... A63F 1/14 463/22
2008/0004107 A1 1/2008 Nguyen et al.
2008/0006997 A1* 1/2008 Scheper ..... A63F 1/14 273/149 R
2008/0006998 A1* 1/2008 Grauzer ..... A63F 1/12 273/149 R
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 Lemay et al.
2008/0111300 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beatty
2008/0284096 A1 11/2008 Toyama et al.
2008/0303210 A1* 12/2008 Grauzer ..... A63F 13/80 273/149 R
2008/0315517 A1 12/2008 Toyama
2009/0026700 A2 1/2009 Shigeta
2009/0048026 A1 2/2009 French
2009/0054161 A1 2/2009 Schubert et al.
2009/0072477 A1 3/2009 Tseng
2009/0091078 A1 4/2009 Grauzer et al.
2009/0100409 A1 4/2009 Toneguzzo
2009/0104963 A1 4/2009 Burman et al.
2009/0121429 A1 5/2009 Walsh
2009/0134575 A1* 5/2009 Dickinson ..... A63F 1/062 273/149 R
2009/0140492 A1* 6/2009 Yoseloff ..... G07F 17/3293 273/149 R
2009/0166970 A1 7/2009 Rosh
2009/0176547 A1 7/2009 Katz
2009/0179378 A1 7/2009 Amaitis et al.
2009/0186676 A1 7/2009 Amaitis et al.
2009/0191933 A1 7/2009 French
2009/0194988 A1 8/2009 Wright et al.
2009/0197662 A1 8/2009 Wright et al.
2009/0224476 A1 9/2009 Grauzer et al.
2009/0227318 A1 9/2009 Wright et al.
2009/0227360 A1 9/2009 Gioia et al.
2009/0243213 A1* 10/2009 Pececnik ..... B65H 83/025 273/149 R
2009/0250873 A1 10/2009 Jones
2009/0253478 A1 10/2009 Walker et al.
2009/0253503 A1 10/2009 Krise et al.
2009/0267297 A1 10/2009 Blaha et al.
2009/0283969 A1 11/2009 Tseng
2009/0298577 A1 12/2009 Gagner et al.
2009/0302535 A1 12/2009 Ho
2009/0302537 A1* 12/2009 Ho ..... A63F 1/12 273/149 R
2009/0312093 A1 12/2009 Walker et al.
2009/0314188 A1 12/2009 Toyama et al.
2010/0013152 A1 1/2010 Grauzer et al.
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer et al.
2011/0006480 A1 1/2011 Grauzer et al.
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta et al.
2011/0078096 A1 3/2011 Bounds
2011/0079959 A1 4/2011 Hartley
2011/0105208 A1 5/2011 Bickley
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci
2011/0183748 A1 7/2011 Wilson et al.
2011/0230148 A1 9/2011 Demuynck et al.
2011/0230268 A1 9/2011 Williams
2011/0269529 A1 11/2011 Baerlocher
2011/0272881 A1 11/2011 Sines
2011/0285081 A1 11/2011 Stasson
2011/0285082 A1 11/2011 Krenn et al.
2011/0287829 A1 11/2011 Clarkson et al.
2012/0015724 A1 1/2012 Ocko et al.
2012/0015725 A1 1/2012 Ocko et al.
2012/0015743 A1 1/2012 Lam et al.
2012/0015747 A1 1/2012 Ocko et al.
2012/0021835 A1 1/2012 Keller et al.
2012/0034977 A1 2/2012 Kammler
2012/0061914 A1* 3/2012 Kwon ..... A63F 1/06 273/149 R
2012/0062745 A1 3/2012 Han et al.
2012/0074646 A1 3/2012 Grauzer et al.
2012/0091656 A1* 4/2012 Blaha ..... A63F 1/12 273/149 R
2012/0095982 A1 4/2012 Lennington et al.
2012/0161393 A1 6/2012 Krenn et al.
2012/0175841 A1 7/2012 Grauzer et al.
2012/0181747 A1 7/2012 Grauzer et al.
2012/0187625 A1 7/2012 Downs et al.
2012/0242782 A1 9/2012 Huang
2012/0286471 A1 11/2012 Grauzer et al.
2012/0306152 A1 12/2012 Krishnamurty et al.
2013/0020761 A1 1/2013 Sines et al.
2013/0023318 A1 1/2013 Abrahamson
2013/0026709 A1 1/2013 Sampson et al.
2013/0085638 A1 4/2013 Weinmann et al.
2013/0109455 A1 5/2013 Grauzer et al.
2013/0132306 A1 5/2013 Kami et al.
2013/0147116 A1 6/2013 Stasson
2013/0161905 A1 6/2013 Grauzer et al.
2013/0228972 A1 9/2013 Grauzer et al.
2013/0241147 A1 9/2013 McGrath
2013/0300059 A1 11/2013 Sampson et al.
2013/0337922 A1 12/2013 Kuhn et al.
2014/0027979 A1* 1/2014 Stasson ..... H05K 999/00 273/149 R
2014/0094239 A1 4/2014 Grauzer et al.
2014/0103606 A1 4/2014 Grauzer et al.
2014/0138907 A1 5/2014 Rynda et al.
2014/0145399 A1 5/2014 Krenn et al.
2014/0171170 A1 6/2014 Krishnamurty et al.
2014/0175724 A1 6/2014 Huhtala et al.
2014/0183818 A1 7/2014 Czyzewski et al.
2014/0309006 A1 10/2014 Shigeta
2014/0346732 A1 11/2014 Blaha et al.
2015/0014926 A1 1/2015 Scheper et al.
2015/0021242 A1 1/2015 Johnson
2015/0069699 A1 3/2015 Blazevic
2015/0196833 A1 7/2015 Scheper et al.
2015/0196834 A1 7/2015 Scheper et al.
2015/0238848 A1* 8/2015 Kuhn ..... A63F 1/12 273/149 R
2015/0290528 A1 10/2015 Sampson et al.
2015/0290529 A1 10/2015 Bourbour et al.

(56) References Cited

U.S. PATENT DOCUMENTS

| | | | | |
|---|---|---|---|---|
| 2015/0328533 | A1* | 11/2015 | Haushalter | A63F 1/12 273/149 R |
| 2016/0030831 | A1* | 2/2016 | Stasson | A63F 1/12 273/149 R |
| 2017/0157499 | A1* | 6/2017 | Krenn | A63F 1/12 |
| 2018/0043241 | A1 | 2/2018 | Blaha et al. | |
| 2018/0085658 | A1* | 3/2018 | Helsen | A63F 1/14 |
| 2018/0089956 | A1 | 3/2018 | Nagaragatta et al. | |
| 2018/0200610 | A1 | 7/2018 | Riordan et al. | |

FOREIGN PATENT DOCUMENTS

| | | | |
|---|---|---|---|
| AU | 06978/05 | B2 | 10/1998 |
| AU | 0757636 | B2 | 2/2003 |
| CA | 2266555 | A1 | 4/1998 |
| CA | 2284017 | C | 5/2006 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 201832397 | U | 5/2011 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CN | 103025393 | B | 5/2015 |
| CZ | 0024952 | U1 | 2/2013 |
| DE | 0291230 | C | 4/1916 |
| DE | 2757341 | A1 | 6/1978 |
| DE | 2816377 | A1 | 10/1979 |
| DE | 3807127 | A1 | 9/1989 |
| EP | 0777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 0289552 | A | 4/1928 |
| GB | 0337147 | A | 10/1930 |
| GB | 0414014 | A | 7/1934 |
| GB | 0672616 | A | 5/1952 |
| GB | 2382567 | A | 6/2003 |
| JP | 10-063933 | A | 3/1998 |
| JP | 11-045321 | A | 2/1999 |
| JP | 2000-251031 | A | 9/2000 |
| JP | 2001-327647 | A | 11/2001 |
| JP | 2002-165916 | A | 6/2002 |
| JP | 2003-154320 | A | 5/2003 |
| JP | 2003-250950 | A | 9/2003 |
| JP | 2005198668 | A | 7/2005 |
| JP | 2006-092140 | A | 4/2006 |
| JP | 2008-246061 | A | 10/2008 |
| JP | 4586474 | B2 | 11/2010 |
| KR | 20180090299 | A | 8/2018 |
| TW | M335308 | U | 7/2008 |
| TW | M357307 | U | 5/2009 |
| TW | M359356 | U | 6/2009 |
| TW | I345476 | B | 7/2011 |
| WO | 87/00764 | A1 | 2/1987 |
| WO | 92/21413 | A1 | 12/1992 |
| WO | 95/28210 | A1 | 10/1995 |
| WO | 96/07153 | A1 | 3/1996 |
| WO | 97/10577 | A1 | 3/1997 |
| WO | 98/14249 | A1 | 4/1998 |
| WO | 98/40136 | A1 | 9/1998 |
| WO | 99/43404 | A1 | 9/1999 |
| WO | 99/52610 | A1 | 10/1999 |
| WO | 99/52611 | A1 | 10/1999 |
| WO | 01/56670 | A1 | 8/2001 |
| WO | 02/05914 | A1 | 1/2002 |
| WO | 01/78854 | A3 | 2/2002 |
| WO | 2003/004116 | A1 | 1/2003 |
| WO | 03/26763 | A1 | 4/2003 |
| WO | 2004/067889 | A1 | 8/2004 |
| WO | 2004/112923 | A1 | 12/2004 |
| WO | 2006/031472 | A2 | 3/2006 |
| WO | 06/39308 | A2 | 4/2006 |
| WO | 2007/117268 | A1 | 10/2007 |
| WO | 2008/005285 | A2 | 1/2008 |
| WO | 2008/005286 | A2 | 1/2008 |
| WO | 2008/006023 | A2 | 1/2008 |
| WO | 2008/091809 | A2 | 7/2008 |
| WO | 2009/067758 | A1 | 6/2009 |
| WO | 2009/137541 | A2 | 11/2009 |
| WO | 2010/052573 | A2 | 5/2010 |
| WO | 2010/055328 | A1 | 5/2010 |
| WO | 2010/117446 | A1 | 10/2010 |
| WO | 2012/053074 | A1 | 4/2012 |
| WO | 2013/019677 | A1 | 2/2013 |
| WO | 2016/058085 | A9 | 5/2016 |

OTHER PUBLICATIONS

"i-Deal," Bally Technologies, Inc., (2014), 2 pages.

"Playtech Retail begins roll out of Neon across Grosvenos 55 UK Casinos" Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).

"shufflers—SHFL entertainment", Gaming Concepts Group, (2012), 6 pages.

1/3 B/W CCD Camera Module EB100 by EverFocus Electronics Corp., Jul. 31, 2001, 3 pgs.

ACE, Single Deck Shuffler, Shuffle Master, Inc., (2005), 2 pages.

Australian Examination Report for Australian Application No. 2008202752, dated Sep. 25, 2009, 2 pages.

Australian Examination Report for Australian Application No. 2010202856, dated Aug. 11, 2011, 2 pages.

Australian Provisional Patent Application for Australian Patent Application No. PM7441, filed Aug. 15, 1994, Applicants: Rodney G. Johnson et al., Title: Card Handling Apparatus, 13 pages.

Automatic casino card shuffle, Alibaba.com, (last visited Jul. 22, 2014), 2 pages.

Bally Systems Catalogue, Ballytech.com/systems, 2012, 13 pages.

CasinoTrac TableTrac Services. Product Information Datasheet [online], CasinoTrac, 2015. Retrieved on Oct. 12, 2016 from the Internet: <URL: http://www.tabletrac.com/?pageid=15#prettyPhoto> (3 pages).

Christos Stergiou and Dimitrios Siganos, "Neural Networks," http://www.doc.ic.ac.uk/~nd/surprise_96/journal/vol4/cs11/report.html (13 pages), Dec. 15, 2011.

Complaint filed in the matter of SHFL entertainment, In. v. DigiDeal Corporation, U.S. District Court, District of Nevada, Civil Action No. CV 2:12-cv-01782-GMC-VCF, Oct. 10, 2012, 62 pages.

CONNECT2TABLE Administrator Manual, Jan. 7, 2013 (82 pages).

CONNECT2TABLE Connect2Table System Summary, generated Oct. 21, 2016 (2 pages).

CONNECT2TABLE Quick Installation Guide, Feb. 20, 2013 (36 pages).

CONNECT2TABLE User Manual, Feb. 7, 2013 (35 pages).

(56) References Cited

OTHER PUBLICATIONS

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 18 of 23 color copies from Binder 1).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 19 of 23 color copies from Binder 3).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 20 of 23 color copies from Binder 4).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 21 of 23 color copies from Binder 6).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 22 of 23 color copies from Binder 8, part 1 of 2).
Documents submitted in case of*Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in case of*Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of color pages, for clarity, Part 23 of 23 Kcolor copies from Binder 8, part 2 of 2).
Documents submitted in the case of *Shuffle Master, Inc.* v. *6Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Aurstria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of*Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*,Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having No. contents Binder 6, 1 of 2).
DVD labeled Exhibit 1. This is a DVD taken by Shuffle Master personnel of the live operation of a CARD One2Six (Trademark) Shuffler (Oct. 7, 2003). DVD sent to Examiner by US Postal Service with copy of this PTO/SB/08 form.
DVD labeled Luciano Decl. Ex. K is (see Binder 2-1, p. 215/237, Luciano DecL, para.14): A video demonstration (11 minutes) of a Luciano Packaging prototype shuffler. DVD sent to Examiner by US Postal Service with copy of this PTO/SB/08 form.
DVD labeled Morrill Decl. Ex. A is (see Binder 4-1, p. 149/206, Morrill Deck, para. 2): A video (16 minutes) that the attorney for CARD, Robert Morrill, made to describe the Roblejo prototype card shuffler. DVD sent to Examiner by US Postal Service with copy of this PTO/SB/08 form.
DVD labeled Solberg DecLEx.C, which is not a video at all, is (see Binder 4-1, p. 34/206, Solberg Deck, para.8) Computer source code for operating a computer-controlled card shuffler (an early Roblejo prototype card shuffler) and Descriptive comments of how the code works. DVD sent to Examiner by US Postal Service with copy of this PTO/SB/08 form.
Error Back propagation, http://willamette.edu~gorr/classes/cs449/backprop.htm1(4 pages), Nov. 13, 2008.
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N D. III.); Oct. 13, 2016; pp. 1, 9-21, 30-69, 150-167,186-188, 228-231,290-315, 411; Henderson Legal Services, Inc.; Washington, DC.
Gros, Roger; New Card Management System To Be Tested At Bally's Park Place; Casino Journal; Apr. 1989; 5 pages.
http://www.google.com/search?tbm=pts&q=Card+handling+device+with+input+and- +outpu . . . , Jun. 8, 2012.
http://www.ildado.com/casino_glossary.html, Feb. 1, 2001, p. 1-8.
https://web.archive.org/web/19991004000323/http7/travelwizardtravel.com/majon.htm, Oct. 4, 1999,2 pages.
International Search Report from International Application No. PCT/US2019/050436, dated Dec. 12, 2019, 4 pages.
International Written Opinion from International Application No. PCT/US2019/050436, dated Dec. 12, 2019, 7 pages.
Litwiller, Dave, CCD vs. CMOS: Facts and Fiction reprinted from Jan. 2001 Issue of Photonics Spectra, Laurin Publishing Co. Inc. (4 pages).
NEON Product Information Datasheets [online], "Enterprise Casino Management, Table Management System, Mobile, Gaming". Intel-

(56) References Cited

OTHER PUBLICATIONS ligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler 'ready' for Atlantic City experiment; Blackjack Confidential; Jul./Aug. 1989; pp. 6-7.
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp., et al*. 1:15-cv-3702 (N.D. III); undated; pp. 1-4.
Scame's Encyclopedia of Games by John Scarne, 1973, "Super Contract Bridge", p. 153.
Service Manual/User Manual for Single Deck Shufflers: BG1, BG2 and BG3 by Shuffle Master (copyright) 1997, 151 page.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master Gaming, Service Manual, ACE(trademark) Single Deck Card Shuffler, (1998), 63 pages.
Shuffle Master Gaming, Service Manual, Let It Ride Bonus (Register) With Universal Keypad, 112 pages, (Copyright) 2000 Shuffle Master, Inc.
Shuffle Master's Reply Memorandum in Support of Shuffle Master's Motion for Preliminary Injunction for *Shuffle Master, Inc*. vs. *VendingDala Corporation*, In the U.S. District Court, District of Nevada, No. CV-S-04-1373-JCM-LRL, Nov. 29, 2004.
Shuffle Master, Inc. (1996) Let It Ride, The Tournament, User Guide, 72 pages.
*Shuffle Tech International LLC* et al. vs. *Scientific Games Corporation et al*.. Order Denying Motion for Summary Judgement: Memorandum Opinion and Order, In the U.S. District Court, For The Northern District of Illinois Eastern Division, No. 15 C 3702, Sep. 1, 2017, 35 pages.
Solberg, Halvard; Deposition; *Shuffle Tech International* v. *Scientific Games Corp., et al*. 1:15-cv-3702 (N.D. III.); Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online], Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online], Advansys, 2013. Retrieved on Oct. 11, 2016 from the Internet: <URL: http://advansys.si/products/tablescanner/> (4 pages).
TAG Archives: Shuffle Machine, Gee Wiz Online, (Mar. 25, 2013), 4 pages.
Tbm=pts&hl=en Google Search for card handling device with storage area, card removing system pivoting arm and processor http://www.google com/?tbm=pts&hl=en; Jul. 28, 2012, 2 pages.
Tracking the Tables, by Jack Bularsky, Casino Journal, May 2004, vol. 17, No. 5, pp. 44-47.
TYM @ A Glance—Table Games Yield Management, TYN LIVE Product Information Datasheets [online], TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc*. vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc*. vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc*. vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc*. vs. *VendingData Corporation*, In the U.S District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.
Canadian Office Action for Canadian Application No. 3,033,280, dated Apr. 14, 2021,4 pages.
European Examination Report for European Application No. 07 853 071.4, dated Aug. 10, 2018, 7 pages.
European Examination Report for European Application No. 02 780 410, dated Jan. 25, 2010, 5 pages.
Philippines Office Action, for Philippines Application No. 1/2018/501139, dated Apr. 8, 2021, 3 pages.
Taiwan Examination Report, forTaiwan Application No. 106131789, dated Mar. 31, 2021, 19 pages with English Translation.
International Preliminary Report on Patentability Chapter 1 for PCT/US19/50436, dated Mar. 16, 2021, 8 pages.
Australian Examination Report, for Australian Application No. 2016363815, dated Feb. 3, 2021, 4 pages, with English Translation.
International Preliminary Report on Patentability, for International Application No. PCT/US2019/027460, dated Mar. 9, 2021, 10 pages.

* cited by examiner

CARD-HANDLING DEVICES AND RELATED METHODS, ASSEMBLIES, AND COMPONENTS

CROSS-REFERENCE TO RELATED APPLICATIONS

This application is a continuation-in-part of U.S. patent application Ser. No. 16/132,090, filed Sep. 14, 2018, pending, and a continuation-in-part of PCT Application No. PCT/US19/027460, filed Apr. 15, 2019, pending, the disclosure of each of which is hereby incorporated herein in its entirety by this reference.

TECHNICAL FIELD

The disclosure relates to card-handling devices and related assemblies, components, and methods. In particular, embodiments of the disclosure relate to card-handling devices, card input portions of card-handling devices, card output portions of card-handling devices, card-shuffling carousels of card-handling devices, and methods of shuffling cards.

BACKGROUND

Wagering games are often based on the outcome of randomly generated arrangements of cards. Such games are widely played in gaming establishments and, often, a single deck or multiple decks of fifty-two (52) playing cards may be used to play the game. Gaming using multiple decks of playing cards may include, for example, six to ten decks used in games such as blackjack and baccarat and one or two decks of playing cards used in games such as single and double deck blackjack. Many other specialty games may use single or multiple decks of cards, with or without jokers and with or without selected cards removed or special cards added.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One option to increase revenue is to decrease the time the dealer spends handling and shuffling playing cards. This may be accomplished by using one set of cards to administer the game while shuffling a second set of cards. Other options include decreasing shuffling time.

The desire to decrease shuffling time has led to the development of mechanical and electromechanical card-shuffling devices. Such devices increase the speed of shuffling and dealing, thereby increasing actual playing time. Such devices also add to the excitement of a game by reducing the amount of time the dealer or house has to spend in preparing to play the game.

However, the card output area or shoe used in conjunction with shufflers often places strain on dealers' hands and wrists by using card distribution interfaces to output cards that are oriented at a substantial acute angle relative to the table surface. To draw cards from these shoes, dealers often have to twist their wrists repeatedly at awkward and uncomfortable angles. Moreover, shoes often are not easily adjustable to meet a dealer's card drawing preference (e.g., direction in which dealers prefer to draw a card relative to the table).

Card counting is also a significant problem, for example, when administering a card game dealt from a shoe. Automatic card shufflers or hand shuffling methods may be used to prepare cards for insertion into the shoe. Casinos often lose a house advantage when players are able to predict what cards remain to be dealt from the shoe and the proximity of those cards to being dealt. It is desirable for casinos to reduce or eliminate the ability for players to count cards. Continuous shuffling machines assist in reducing the ability to count cards, but additional ways to eliminate card counting and improve ergonomics of card delivery would be desirable.

An automatic shuffler that continuously supplies cards to a shoe end for games such as blackjack, baccarat and Casino War, such as the shuffler disclosed in U.S. Patent Publication US2018/0243642 A1, may be problematic to card counters because the majority of the cards remain in the shuffler while a small group of cards is removed to play the game and then returned and intermixed with the cards remaining in the shuffler. There is no "shuffling cycle" or beginning and end to a shuffle. Therefore, players cannot count cards or predict when the shuffler will deliver high value cards more frequently.

When a batch type shuffler is used such as the device described in U.S. Pat. No. 9,220,971, a first set of cards is inserted into the shuffler, shuffled and delivered as a multiple deck set while a second shuffled multiple deck set of cards is being dealt from a shoe. A cut card is placed near the end of the card set in the shoe, and when the dealer draws the cut card, no more rounds may be dealt from the shoe. When batch shuffling is used to randomize the set of cards being transferred to a shoe, players may track the high value cards and estimate the deck penetration to increase bets if the last portion of the shoe is rich in high value cards.

Automatic card shufflers that process relatively large groups of cards, such as eight or more decks, in a single shuffling cycle suffer from having long duration shuffling cycles as compared to a single deck, hand-forming shuffler, for example. For this reason, it is common for a casino to use two complete sets of cards on games administered from a shoe. The casino typically uses a batch-type card shuffler to prepare cards for loading into the shoe while the other set of cards is in play. Even though there is typically sufficient time to perform a shuffle using two sets of cards, it is desirable for the shuffler to perform its operations as swiftly as possible so that the next set of cards is ready for use in the event that the house requires the dealer to change shoes on short notice. The dealer also may decide to change cards long before the cut card is drawn if he or she suspects players have been counting cards or cheating in other ways. If the next group of cards is not yet completely shuffled, the game may be delayed. Any delay in shuffling can cause a revenue loss for the casino, and should generally be avoided.

Modern shufflers contain many security features to assure that the set of shuffled cards is complete and adequately shuffled. For example, modern shufflers perform a count of shuffled cards to verify the set is complete. Some newer shufflers read the rank and suit of each card shuffled to verify that the card set composition is correct. If the shuffler stops shuffling for any reason, such as detecting extra or fewer cards in the set, or due to a shuffler malfunction, the game may be delayed, and revenue can be lost. Although it is desirable to stop a game that is using an invalid set of cards for security reasons, there are other reasons why a game might be delayed, such as when a shuffler malfunctions, or the shuffler aborts the shuffle because of unreadable cards. When a shuffler with card recognition is employed in a casino, it may have a card recognition system that is trained to only read card faces. If the card reader attempts to read a flipped card that exposes the card back to the reader, the card reader may fail to recognize the card. Other card reading systems may be trained to recognize a card back so that when a card is flipped and the card back is read, the system may generate a signal indicating that a card is flipped over. Flipped cards and unrecognized cards typically cause the machine to abort the entire shuffle. Any time a shuffle is aborted, the game can be delayed, causing revenue loss for the casino.

BRIEF SUMMARY

Some embodiments of the present disclosure may include a card-handling device. The card-handling device may include a card intake, a playing card-shuffling apparatus, a card rotation device, and a card output. The card intake may be configured to receive one or more playing cards. The output may be configured to provide at least one of the one or more playing cards. The playing card-shuffling apparatus may be positioned along a card path between the card intake and the card output. The playing card-shuffling apparatus may be configured to randomize at least some of the one or more playing cards. The card rotation device may be positioned along the card path between the card intake and the card output. The card rotation device may be configured to rotate at least one of the one or more playing cards about a minor axis of the one or more playing cards to randomly alter an orientation of lateral edges of the one or more playing cards. The minor axis of the one or more playing cards may extend through a thickness of the at least one of the one or more playing cards in a direction transverse to a longitudinal axis and a lateral axis thereof. The minor axis may be normal to a plane that is coplanar with a face of a card and may be located in the center of the card.

Some embodiments of the present disclosure may include a method of deterring card edge pattern cheating. The method may include receiving cards in a card-handling device. The method may further include transporting the cards between a card rotation device and a card-shuffling apparatus. The method may also include rotating the cards with the card rotation device from a first orientation to a second orientation about a minor axis of the cards after one or more cards are received in the card rotation device to alter an orientation of lateral edges of the cards. The minor axis of the cards may extend through a thickness of the cards in a direction transverse to a longitudinal axis and a lateral axis of the cards to randomize an orientation of the lateral edges of the cards. The method may further include shuffling an order of the cards in the card-shuffling apparatus. The method may also include outputting at least one card to a card output area after the at least one card has been transported through both the card rotation device and the card-shuffling apparatus.

Some embodiments of the present disclosure may include a card-handling device including a playing card-shuffling apparatus and a card rotation device. The card rotation device may be configured to rotate one or more playing cards about a minor axis of the one or more playing cards to alter an orientation of lateral edges of the one or more playing cards. The minor axis of the one or more playing cards extends through a thickness of the one or more playing cards in a direction transverse to a longitudinal axis and a lateral axis of the one or more playing cards. The card rotation device may be configured to rotate the one or more playing cards as at least one of the one or more playing cards enters the shuffling apparatus.

Some embodiments of the present disclosure may include a card-handling device including a card input configured to rotate at least one playing card from a group of playing cards about a minor axis of the at least one playing card to alter an orientation of lateral edges of the at least one playing card. The minor axis of the at least one playing card extends through the thickness of the at least one playing card in a direction transverse to a longitudinal axis and lateral axis of the at least one playing card. The card input may be configured to enable the at least one playing card to be provided to a card-shuffling apparatus for shuffling playing cards after the orientation of the at least one playing card has been altered.

Some embodiments of the present disclosure may include a card-handling device configured to be mounted at or proximate a gaming surface. The card-handling device may include a card-shuffling apparatus and a card rotation device. The card rotation device may be configured to receive playing cards in a substantially flat orientation and alter an orientation of a leading edge of at least some of the playing cards while maintaining at least some of the playing cards in the substantially flat orientation.

Some embodiments of the present disclosure may include a card-handling device configured to be positioned at a gaming structure having a playing surface. The card-handling device may include a card-shuffling apparatus and a card output portion. The card output portion may be configured to receive playing cards from the card-shuffling apparatus when the card output portion is in a first position. The playing cards may be positioned by the card-shuffling apparatus to be received into the card output portion with major faces of the playing cards oriented in a plane substantially transverse to the playing surface. The card output portion may be further configured to transport the playing cards to a second position where at least a portion of the card output portion is accessible from the playing surface.

Some embodiments of the present disclosure may include a method of shuffling cards. The method may include inputting cards into a card rotation device. The method may include rotating the card rotation device about a minor axis of the cards to alter an orientation of lateral edges of the cards to randomize an orientation of the lateral edges of the cards as the cards are being transferred into a card-shuffling apparatus. The minor axis of the cards extends through a thickness of the cards in a direction transverse to a longitudinal axis and a lateral axis of the cards. The method may further include transporting the cards from the card rotation device into a card-shuffling apparatus. The method may include outputting at least one card from the card-shuffling apparatus into a card output area.

Some embodiments of the present disclosure may include a method of shuffling cards. The method may include inputting cards into a card-handling device in an orientation substantially parallel to a horizontal plane. The method may include transporting the cards to a card-shuffling apparatus. The method may further include outputting the cards into a card output area in an orientation substantially perpendicular to the horizontal plane.

Some embodiments of the present disclosure may include a card-handling device including a card-shuffling apparatus. The card-shuffling apparatus may include a carousel having a number of compartments, for example, at least one-hundred compartments. The compartments may be arranged radially about the carousel and configured to hold between one and ten cards in each compartment.

Some embodiments of the present disclosure may include a card-shuffling carousel including compartments arranged radially about the carousel. The compartments may be configured to hold at least one card. The compartments may include an aperture defined by at least two arms and a resilient material. The resilient material may extend between a bottom retention and a top retention in at least one of the at least two arms. The resilient material may have a length greater than a distance between the bottom retention and the top retention. At least one of the bottom retention and the top retention may be a movable connection.

Some embodiments of the present disclosure include a card-handling device for use with a gaming surface. The card-handling device may include a retractable card input portion, a transportation device, a card-shuffling apparatus, and a card outlet. The retractable card input portion may be configured to receive playing cards in an orientation substantially parallel to the gaming surface. The transportation device may be configured to transfer the playing cards from the retractable card input portion to the card-shuffling apparatus within the card-handling device. The card outlet may be configured to receive the playing cards from the card-shuffling apparatus and deliver the playing cards to a location proximate the gaming surface in an orientation substantially transverse to the gaming surface.

Some embodiments of the present disclosure may include a card-handling device configured to be positioned at least partially below a gaming table upper surface. The card-handling device may include a card intake area, a card-shuffling apparatus, and an output area. The card intake area may be configured to feed cards into the card-shuffling apparatus in an orientation substantially parallel to a surface of the gaming table. The output area may be configured to receive the cards from the card-shuffling apparatus in an orientation substantially transverse to the surface of the gaming table in an area beneath the surface of the gaming table and transport the cards to an area at least partially above the surface of the gaming table.

Some embodiments of the present disclosure may include a method of altering an orientation of cards being shuffled in an automatic card shuffler. The method may include providing an automatic card shuffler with a user display; a card intake, a card outlet, a card-shuffling apparatus, a card path between the card intake and the card output, a card-imaging system, at least one processor configured to control the card-imaging system, the user display, and the card shuffler. The card-shuffling apparatus may include multiple compartments. The method may further include receiving a plurality of cards in the card intake. The cards may be arranged in a stack wherein cards are generally arranged with card faces in a face to back orientation. The method may also include automatically feeding each card individually from the stack along the card path and inserting the card into one of the multiple compartments of the card-shuffling apparatus. The method may further include reading card face information of each card as the card is being fed with the card-imaging system. The method may also include identifying unreadable cards, wherein unreadable cards include cards that lack card face information from the card-imaging system. The method may further include inserting the unreadable cards into at least one designated compartment in the card-shuffling apparatus. The method may also include randomly inserting each card not identified as unreadable into a randomly selected compartment. The method may also include unloading all cards except the cards in the at least one designed compartment into the card outlet, forming a stack of cards, wherein each card in the stack of cards is oriented in the face to back orientation. The method may further include unloading the unreadable cards from the at least one designated compartment and adding the unreadable cards to the stack after unloading all other cards. The method may also include causing the user display to display an alert indicating that at least one card in the outlet requires at least one of inspection or reorientation. The method may further include accepting at least one reoriented card from the card output in the card intake. The method may also include automatically feeding each card of the at least one reoriented card in the card intake into the card shuffler. The method may further include unloading the at least one reoriented card in the card shuffler to the card outlet. The method may also include combining the at least one reoriented card with the stack of cards in the card outlet to form a shuffled set of cards in the face to back.

Some embodiments of the present disclosure may include a card-handling device. The card-handling device may include a card intake, a card output, a playing card-shuffling apparatus, and a card-imaging system. The card intake may be configured to receive playing cards. The card output may be configured to provide at least one of the playing cards. The playing card-shuffling apparatus may be positioned along a card path through the card-handling device and configured to randomize at least some of the playing cards, the playing card-shuffling apparatus comprising multiple compartments. The card-imaging system may be positioned along the card path and configured to image a surface of the playing cards. The card-imaging system may be configured to recognize card face information and identify one or more unreadable playing cards. The one or more unreadable playing cards may be playing cards that do not include card face information on the surface of the playing cards oriented toward the card-imaging system. The playing card-shuffling apparatus may be configured to receive the one or more unreadable playing cards in at least one dedicated compartment selected from the multiple compartments.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
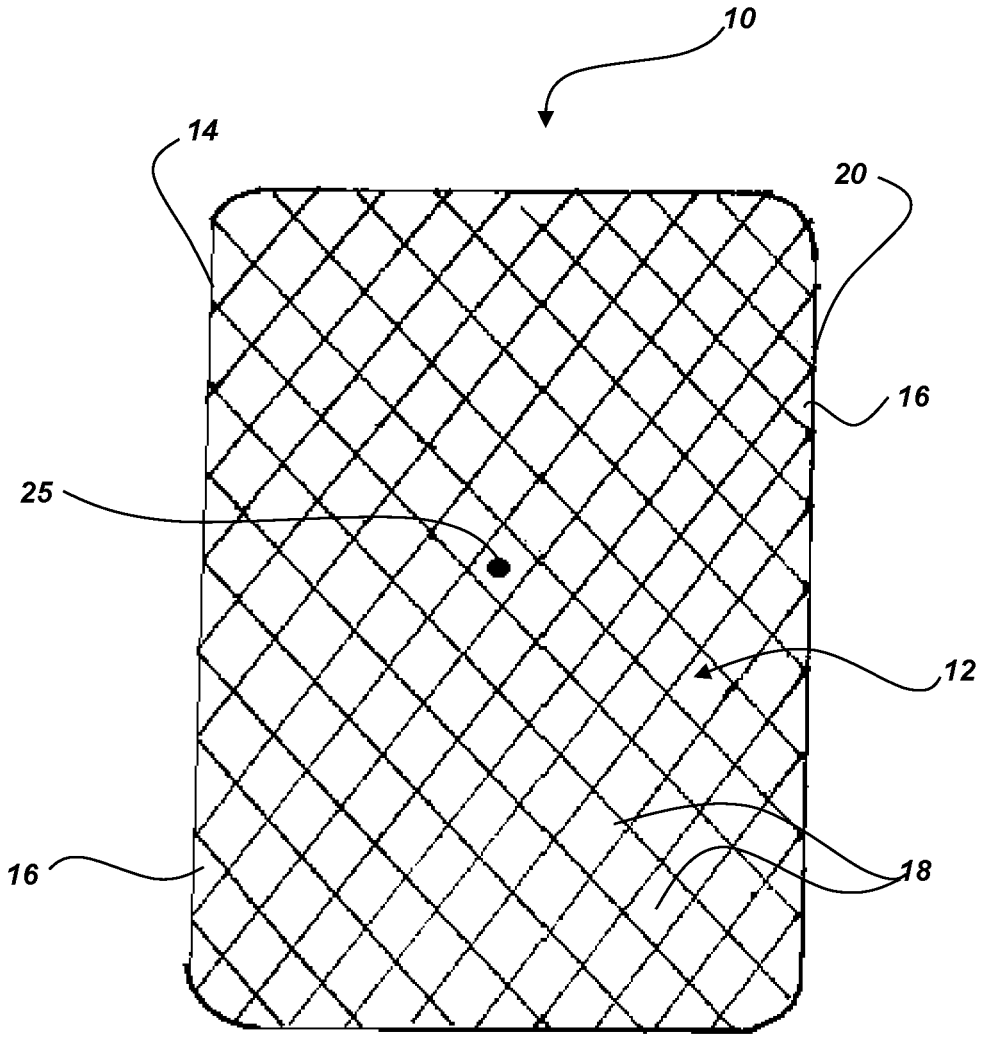
FIG. 1 shows a planar view of a back of a card.

The illustrations presented herein are not meant to be actual views of any particular card-handling device or component thereof, but are merely idealized representations employed to describe illustrative embodiments. The drawings are not necessarily to scale. Elements common between figures may retain the same numerical designation.

As used herein, any relational term, such as "first," "second," "over," "beneath," "top," "bottom," "underlying," "up," "down," etc., is used for clarity and convenience in understanding the disclosure and accompanying drawings, and does not connote or depend on any specific preference, orientation, or order, except where the context clearly indicates otherwise. For example, these terms may refer to an orientation of elements of the card-handling device relative to a surface of a table on which the card-handling device may be positioned, mounted, and/or operated (e.g., as illustrated in the figures).

As used herein, the terms "vertical" and "horizontal" may refer to a drawing figure as oriented on the drawing sheet, and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the card-handling device relative to a table surface of a table to which the card-handling device may be mounted and operated.

As used herein, the term "and/or" means and includes any and all combinations of one or more of the associated listed items.

As used herein, the terms "substantially," "approximately," or "about" in reference to a given parameter means and includes to a degree that one skilled in the art would understand that the given parameter, property, or condition is met with a degree of variance, such as within acceptable manufacturing tolerances, or wherein the variance is with respect to a general parameter, such as an orientation. For example, a parameter that is substantially met may be at least about 90% met, at least about 95% met, at least about 99% met, or even 100% met.

One cheating method employed by card players is often referred to as "edge cheating." Edge cheating takes advantage of imperfections in the card manufacturing process. Most card backs have patterns that intersect the cut lines, while other card backs have solid edges on the cut lines. Players who engage in edge cheating will generally target casinos that use cards with card back patterns that extend to the outer edges of the card backs. This scheme also depends upon the dealer gathering up cards and returning them to the discard rack, shuffler, and/or shoe without rotating the cards about an axis normal to the card face, changing the card orientation. In other words, regardless of where the card is, the same long side of the card remains in the same rotational orientation whether it is on the table, in the shuffler or in the shoe. Dealers generally do not reorient cards because it takes additional time. An edge cheater will generally observe how the dealer handles the cards as the cards are collected off the table and returned to the discard rack to determine if the dealer's handling method retains the same orientation of the cards. If the dealer consistently retains the same card orientation during handling, the cheater will generally select that dealer to engage in edge cheating.

During manufacturing of playing cards, multiple cards are typically printed in rows and columns on a large sheet of card stock and then the individual cards are stamped or otherwise cut from the sheet. The center of the card-cutting die must be aligned centrally with the center of the card back in order for the pattern at the opposite long edges to appear identical, as shown in FIG. 1.

All cards in the deck will likely have approximately the same edge cut pattern, because a large number of cards are cut at the same time from the same sheet of card stock. If one card is slightly misaligned, the others will also be similarly misaligned. As the cards are formed into decks in the factory, the cards maintain the same alignment, and all cards that are misaligned will have an edge pattern along the right long side of the card back that has a different appearance than the edge pattern along the left long side of the card back. Card cheats take advantage of this knowledge.

When cards are manually removed from a shoe or output location, the card is oriented such that the leading edge of the card exiting the shoe is one of the long edges. This cheating method requires the cheater to examine and compare the edge cut patterns near the leading edges of the long sides or the short sides.

Typically, the center of the card back design is slightly misaligned with respect to the center of the card cutter or die. If the card face is perfectly aligned with the die, the card will be cut through the same part of the pattern, and both long edges will appear identical or nearly identical, and edge cheating is not possible. Asymmetrical as used herein may be used to refer to the card backs of the misaligned cut cards. Symmetrical as used herein may be used to refer to the cards that have card backs aligned centrally with the center of the die.

Not all of the card backs with a deck of cards appear identical. The differences between card edge cuts is one of a matter of degree, not an absolute difference. The asymmetrically cut cards will have more variation in the edge cut pattern than the more symmetrical cards.

FIG. 1 shows a card 10 with a fairly symmetrical card back cut pattern. The card 10 may have a first long edge 14 (e.g., first lateral edge) and an opposite long edge 20 (e.g., opposite lateral edge). A diamond shaped pattern 18 may be printed on the entire card back 12, and extend substantially to the outer edges of the card 10. The cut line on each long edge 14, 20 may intersect the center of the diamond shapes in the card back design, forming triangular shapes 16 along the edges. The triangular shapes 16 may be substantially the same in size and shape on both the first long edge 14 and the opposite long edge 20 on a symmetrically cut card. The card back 12 may be considered symmetrical when the cut lines bisect the pattern at the same position of the pattern on both long edges 14, 20 of the card 10.

In order to engage in this card cheating method, the player may rotate some or all favorable cards (e.g., high value cards, ten value cards, face cards, low value cards, etc.) 180° about a minor axis 25 (e.g., an axis extending into the paper, an axis in the z plane) on the table or in the player's hand before the cards are collected by the dealer. The next time this same card is drawn, the opposite leading edge will come out of the shoe first, and the player will recognize the edge as different, giving the player advance knowledge of the card's value.

Figure 2:
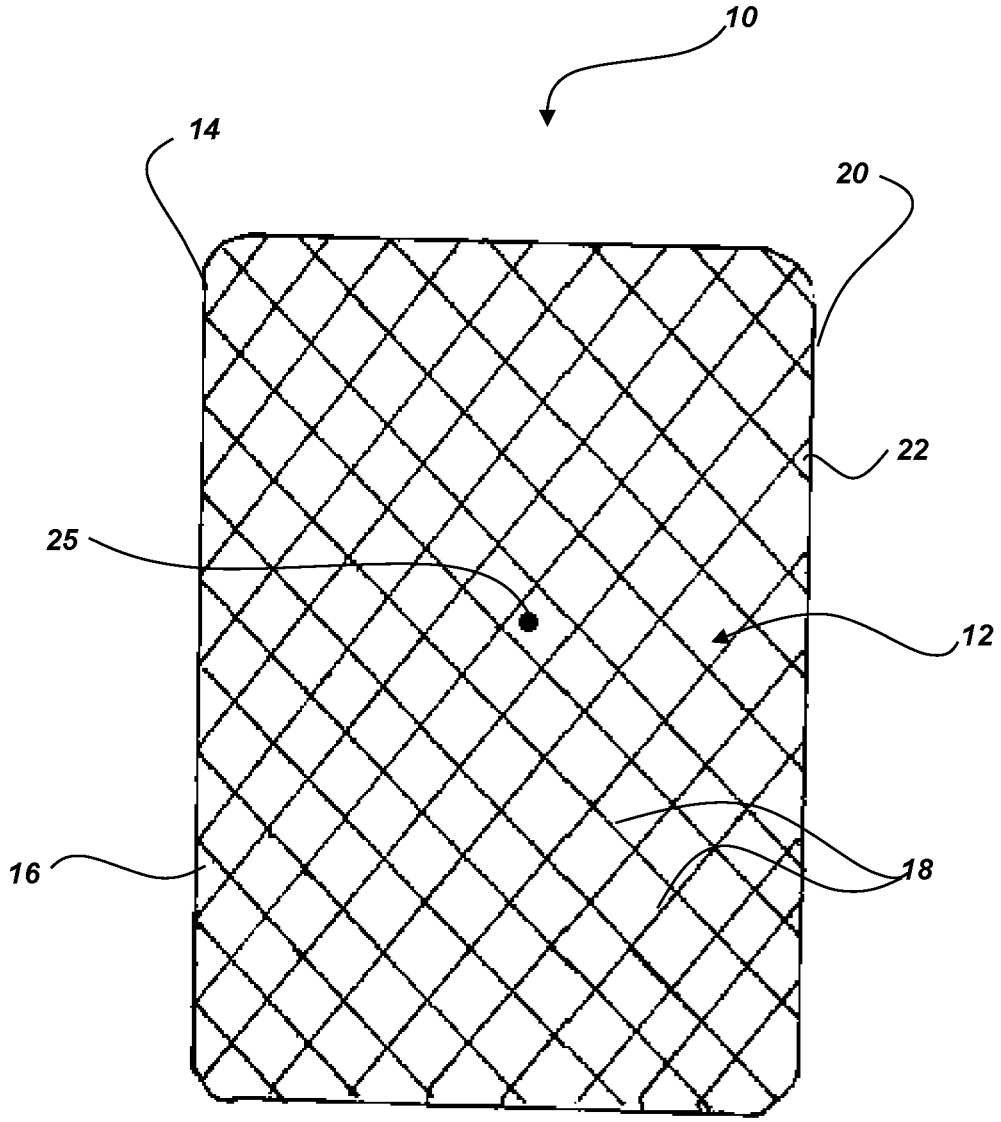
FIG. 2 shows a planar view of a back of the card.

FIG. 2 illustrates another embodiment of the card 10 cut asymmetrically with respect to the card back design. Triangle shapes 22 along the opposite long edge 20 may be substantially smaller than the triangle shapes 16 located along the first long edge 14 of the card 10. This asymmetry provides the cheater with a visual indication on the card back that the two long edges 14, 20 are different. Therefore, the cheater may interpret that the card was previously rotated by the player indicating a favorable card.

In some embodiments, the edge cheater may rotate the asymmetrical card in FIG. 2 about axis 25 if the card is a favorable card. As cards move off the table, into the shuffler then back into the shoe, the orientation of the cards generally does not change. The edge cheater player may rotate all favorable cards that are dealt to the player 180° in their hand or at their player position such that after the cards are returned to the shuffler and/or placed into the shoe, and the same card is dealt again, the player will have advance knowledge of the card value because the leading long edge of the card will look different than the other card edges. When the shoe with the repositioned cards is used to supply cards to a blackjack game, the card edge information may be used to determine when a favorable card is drawn. This knowledge can be used to determine when to take a hit card, or when to increase a bet, giving the cheating player an advantage over the house.

If the casino is using a continuous shuffler, such as, for example, the Shuffle Star shuffler as described in U.S. Patent Application Publication No. U.S. 2018/0243642 A1, the disclosure of which is hereby incorporated herein in its entirety by this reference, the edge cheater may still gain an advantage using this cheating method. Each time the player handles a favorable card and changes the orientation of the card, the player stands an improved chance of obtaining advanced knowledge of the next card drawn, which may be used to make hit/stand and betting decisions and may give the player a greater advantage over time. For instance, a player may bet a higher amount or make additional bets using this information.

When the card backs have a solid border, "edge detection" can still be used if the border print is not symmetrical with the card back design, or the pattern is not centrally aligned with the border. The "edge detection" would be dependent on the thickness of the solid border between the edge of the print and the card edge, or the print pattern at the border edge instead of at the actual card edge. Edge cheating can be practiced using any cards that have a printed back and that have indicia at the long edges that do not appear identical from edge to edge.

Some embodiments of the present disclosure may include card-handling devices having a card rotation device (e.g., rotatable card input portion, rotatable card intake, rotating elevator, rotating card input device, etc.). The card rotation device may rotate playing cards about a minor axis, normal to a face of the cards, such that an orientation of the lateral edges of the playing cards may be randomized, for example, before entering a shuffling apparatus. Randomizing the orientation of the lateral edges of the playing cards may work to prevent some forms of card manipulation, card recognition, or card counting that are becoming more prevalent in games involving playing cards, for example, by recognizing any visual edge variations (e.g., edge sorting, edge cheating, etc.), differences, and/or anomalies, from manufacture, handling or intentional marking.

Some embodiments of the present disclosure may include a card output storage area (e.g., area where the playing cards are stored after exiting the shuffling apparatus and before entering the gaming area) that stores the playing cards in a substantially horizontal stack. The cards may exit the shuffling apparatus in a substantially vertical orientation (e.g., where a major face of the cards lies in a plane normal to the gaming area). The card output storage area may receive the cards in substantially the same orientation as the cards exiting the shuffling apparatus. A horizontal card output storage area may provide for additional storage space allowing the use of greater numbers of decks over existing designs and may allow for more compact designs providing more efficient use of space. In addition, by providing a larger storage space, larger sets of cards may be shuffled in a shuffling cycle, which increases table productivity because fewer shuffling cycles are required over a fixed unit of time, such as a shift of game play.

Some embodiments may include a shuffling apparatus capable of handling greater numbers of cards than conventional designs. The shuffling apparatus may include multiple compartments for holding cards. In some embodiments, the compartments may include a securing element and a card-handling aperture to make more efficient use of space allowing for a more compact arrangement of the compartments and provide an increased capacity for the shuffling apparatus. In some embodiments, the compartments may be modular, which may result in efficiency improvements especially for repair and replacement of compartments.

Figure 3:
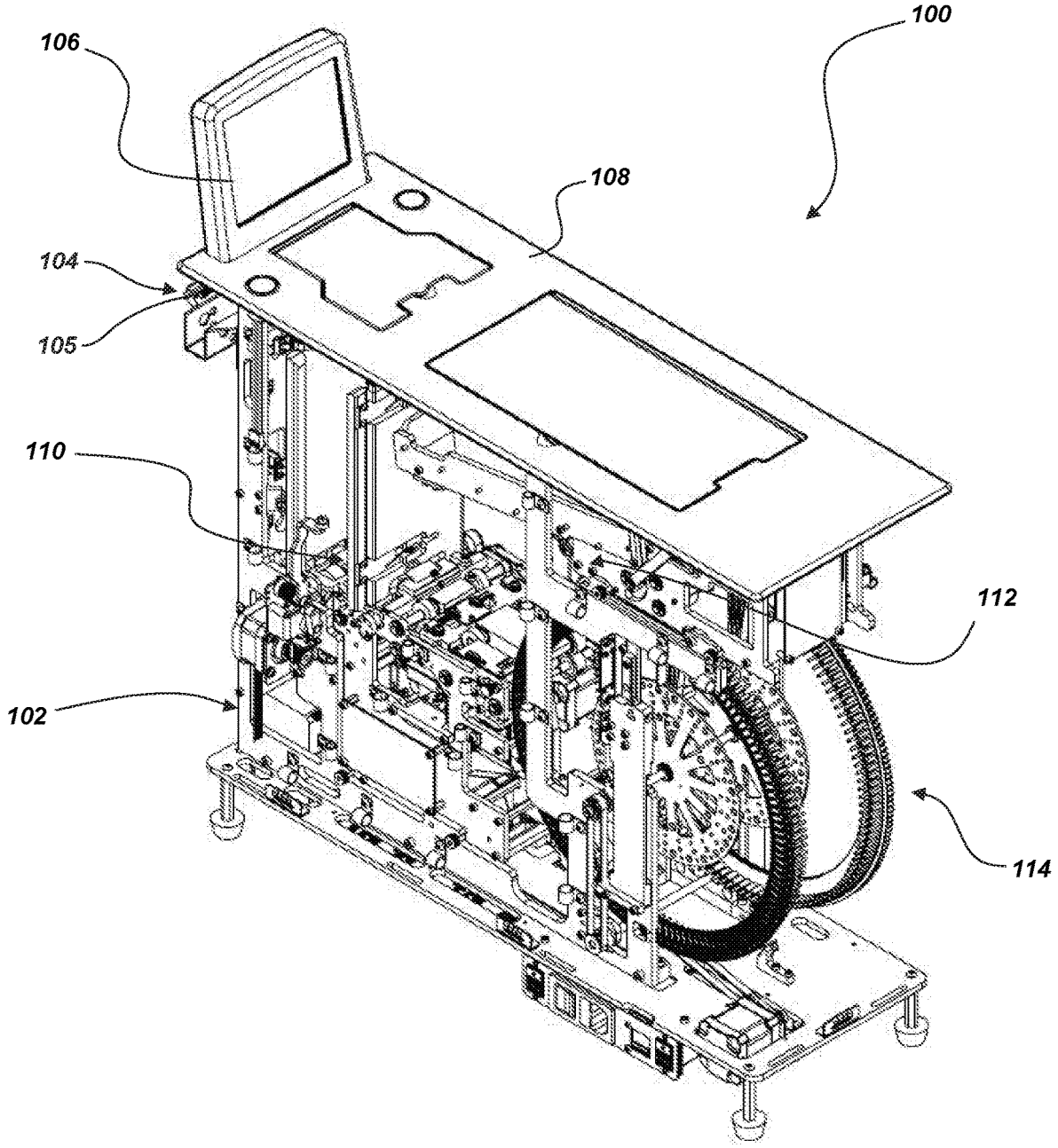
FIG. 3 shows an isometric view of an embodiment of the present disclosure with side covers removed to show the internal mechanism.

FIG. 3 shows a perspective view of a card-handling device 100, according to an embodiment of the present disclosure, having portions of one or more housings (e.g., side covers, panels, etc.) of the card-handling device 100 removed to show interior components of the card-handling device 100. The card-handling device 100 may be configured to be mounted with at least a majority of the card-handling device 100 beneath a level of a gaming structure, for example, a table surface (e.g., a gaming table surface) of a table (e.g., a gaming table) and to deliver shuffled playing cards to the table surface and/or receive playing cards to be shuffled from or proximate the table surface. The card-handling device 100 may include a frame structure 102, a control system 104 in communication with one or more displays 105, 106, and a substantially flat top surface 108 that may be substantially co-planar with the table surface when placed for use with the table. In some embodiments, the control system 104 may include an integrated control panel and/or display 105, which may be utilized by an operator (e.g., a dealer) to operate the card-handling device 100. The integrated control panel and/or display 105 may be positioned to face in a direction toward an expected position of the operator. In some embodiments, the display 106 may be positioned to face in a direction toward an expected position of the players at a gaming surface or table and may be utilized to display game related information (e.g., games odds, game table limits, advertisements, etc.) to the players.

As discussed herein, any disclosure regarding the functioning of the card-handling device 100 and associated components may be performed (e.g., automatically performed without operator intervention) by one or more portions (e.g., local or remote portions) of the card-handling device 100 (e.g., one or more processors of the control system 104, optionally along with associated memory). In other embodiments, the functions may be at least partially performed by (e.g., by inputting one or more commands into the control system 104 or manually), or assisted by, the operator.

Figure 4:
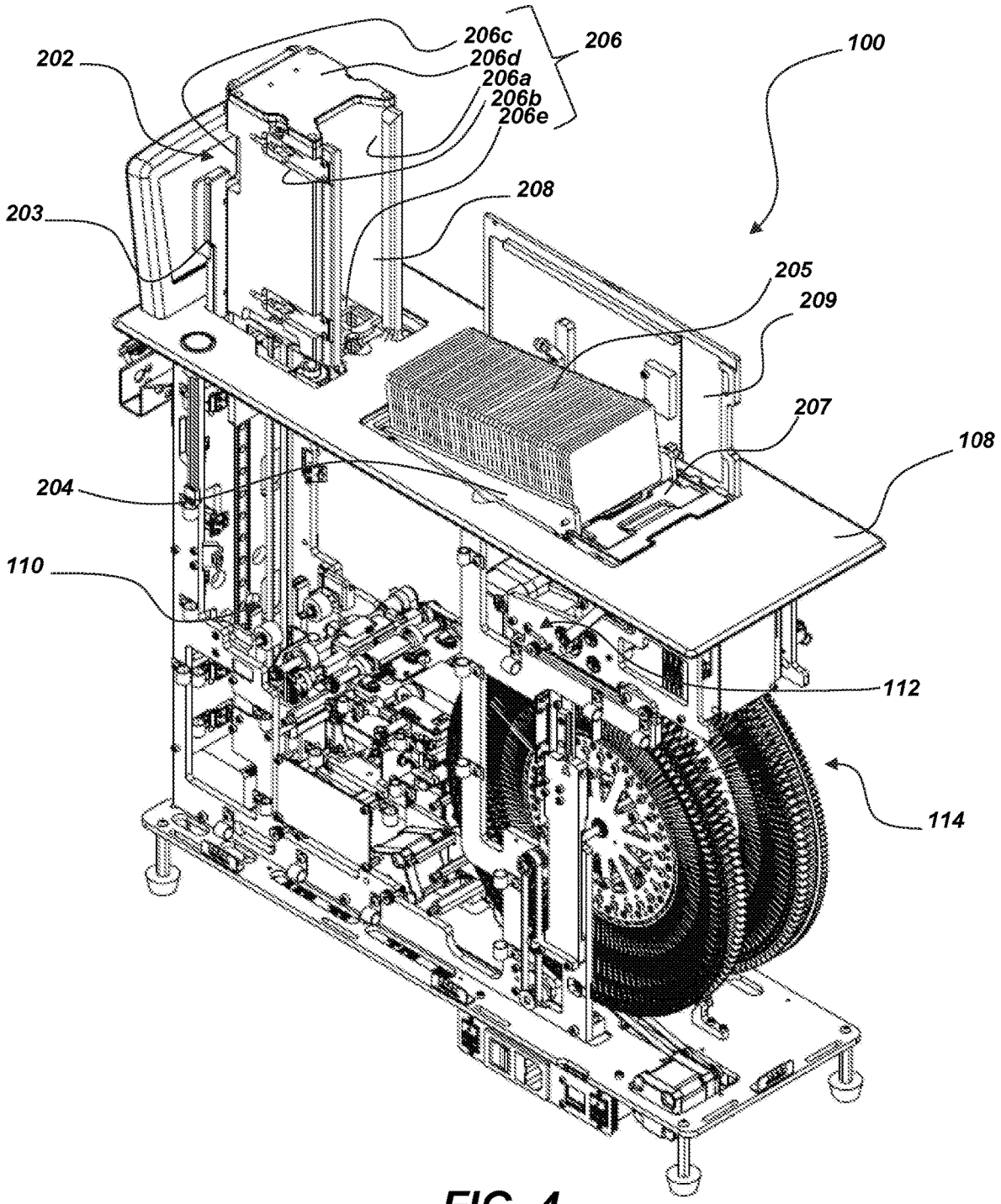
FIG. 4 shows an isometric view of an embodiment of the present disclosure with a set of shuffled cards in the card outlet delivery area and the card intake area in the up position with covers removed to show the internal mechanism.

FIG. 4 shows a perspective view of the card-handling device 100, according to an embodiment of the present disclosure, having portions of one or more housings (e.g., covers) of the card-handling device 100 removed to show interior components of the card-handling device 100. The card-handling device 100 may include a card input portion 110 and a card output portion 112. A set of shuffled cards 205 are shown in the output portion 112. In some embodiments, the card input portion 110 may be configured to move (e.g., elevate) a card intake area 202 toward (e.g., above) the top surface 108 when an operator (e.g., dealer) needs to interact with the card input portion 110, such as, for example, to insert playing cards that are ready to be shuffled into the card intake area 202. The card input portion 110 may retract the card intake area 202 below the top surface 108, as shown in FIG. 3, when the operator does not need to interact with the card input portion 110, or when the playing cards collected in the card intake area 202 are to be shuffled. In some embodiments, the card output portion 112 may be configured to elevate a card outlet 204 and hold a group of shuffled cards 205 above the top surface 108 when an operator needs to interact with the card output portion 112, such as, for example, to remove playing cards 205 that have been shuffled from the card outlet 204 for insertion into a shoe, or to enter the cards 205 directly into game play (e.g., dealing or drawing). The card outlet 204 may retract the card outlet 204 below the top surface 108, as shown in FIG. 3, when the operator does not need to interact with the card outlet 204. When the playing cards collected in the card-shuffling apparatus 114 have been shuffled and are ready to be inserted into the card outlet 204 for reentry into game play, the card outlet 204 may be elevated.

Figure 5:
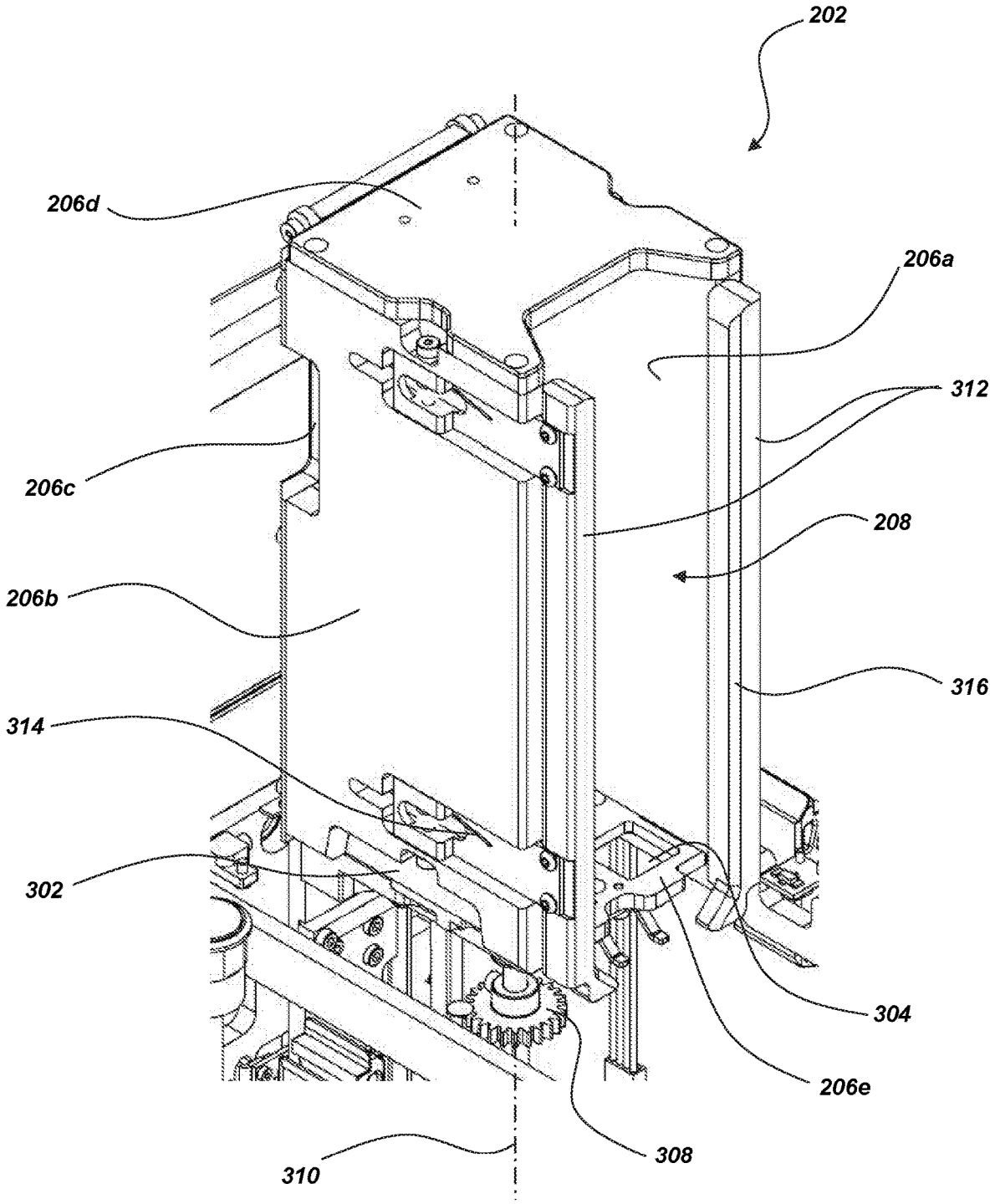
FIG. 5 shows an isometric view of a card intake area according to an embodiment of the present disclosure.

In some embodiments, as shown in FIG. 5, the card intake area 202 may have a partially enclosed internal volume, for example, defined by at least two walls 206. For example, the card intake area 202 may have a first sidewall 206*a* and a second sidewall 206*b*, such that the playing cards can only be placed in the card intake area 202 in one orientation. In some embodiments, the card intake area 202 may include a back wall 206*c* to regulate the uniformity of the stack of playing cards in the intake area 202 by providing a uniform stop when cards are placed in the intake area 202. In some embodiments, the card intake area may include a top wall 206*d* (e.g., a fixed top wall 206*d*) and or a bottom wall 206*e* further defining the intake area. In other embodiments, the top wall 206*d* may be rotatable to open an upper portion of the card intake area 202 for access from above. In some embodiments, the card intake area 202 may include an open face 208 sized and configured to enable cards to be placed within the card intake area 202. In some embodiments, the open face 208 may be a front face of the card intake area 202. In some embodiments, the open face may be a top face. In other embodiments, the open face may be more than one face of the card intake area 202, such as, for example, the front face and a side face, wherein the card intake area 202 is defined by a first sidewall 206*a* and a back wall 206*c*, a first sidewall 206*a*, a back wall 206*c*, and a top wall 206*d*, or any other combination of walls 206. In some embodiments, the card intake area 202 may be defined by walls 206 on every face. For example, the card intake area may be defined by a first sidewall 206*a*, a second sidewall 206*b*, a back wall 206*c*, a top wall 206*d*, a bottom wall 206*e*, and a front wall. In some embodiments, at least one of the walls 206 may include an open area (e.g., slot, aperture, hole, cutout, or gap) and/or may be movable to enable the playing cards to be inserted into the card intake area. In some embodiments, the sidewalls 206*a*, 206*b* may coincide with a long dimension of the playing cards (e.g., longitudinal axis) and the back wall 206*c* may coincide with a short dimension of the playing cards (e.g., lateral axis).

In some embodiments, the card intake area 202 may be configured to hold up to 650 playing cards, such as, between about 50 playing cards and about 650 playing cards, or between about 500 playing cards and about 600 playing cards, or about 520 playing cards (e.g., about ten decks of cards with or without extra cards, such as wild or other special cards).

In some embodiments, the card intake area 202 and card outlet 204 may be configured to elevate and retract relative to the top surface 108 of the card-handling device 100. The card intake area 202 and card outlet 204 may retract below the gaming surface, such that the card-handling device 100 with the exception of display 106, has a minimal, if any profile above the gaming surface, as shown in FIG. 3 (e.g., may be positioned entirely below the top surface 108). A lid 203 as shown in FIG. 4 may open and close to enable the card intake area 202 to be elevated over the top surface 108 and to enclose the card intake area 202 in the card-handling device 100 when the card intake area 202 is retracted. In some embodiments, the lid 203 may rotate between open and closed positions (e.g., on a hinge). In other embodiments, the lid 203 may move in a different manner, for example, the lid 203 may be coupled to the card intake area 202 (e.g., at top wall 206*d*) and may translate above the top surface 108 as the card intake area 202 is elevated. An outlet lid 209 may open and close to enable the card outlet 204 to be elevated over the top surface 108 and to enclose the card output portion 112 in the card-handling device 100 when the card outlet 204 is retracted. In some embodiments, the outlet lid 209 may rotate between open and closed positions. In other embodiments, the outlet lid 209 may move in a different manner, for example, the lid 209 may be coupled to the card outlet 204 and may translate above the top surface 108 as the card outlet 204 is elevated.

Maintaining a low profile while not in use may reduce the area required for the card-handling device to be used in or adjacent to gaming tables, which may reduce the size required for a gaming table to occupy. In some embodiments, the card-handling device 100 may have a profile such that the top surface 108 may be incorporated into the gaming surface with the game being played on at least a portion of the top surface 108 of the card-handling device 100, which may result in the dedicated space for the card-handling device 100 in the surface of the gaming table being reduced and/or eliminated. In other embodiments, the card-handling device may be placed adjacent to a gaming table on the dealer side thereof, and supported by the gaming table via a bracket system or on the casino floor with height-adjustable legs or a pedestal.

FIG. 5 shows an isometric view of the card intake area 202 of the card-handling device 100 in an elevated position. In some embodiments, the card intake area 202 may include at least one sidewall 206*a*, 206*b*, a back wall 206*c*, a top wall 206*d*, and a bottom wall 206*e*. In some embodiments, a gap 302 may be defined between at least one of the sidewalls 206*a*, 206*b* and the bottom wall 206*e* (e.g., both of the sidewalls 206*a*, 206*b*). The gap 302 may be large enough that at least one card may pass through the gap 302 in order to be moved further into the card-handling device 100 for a shuffling operation. In some embodiments, the gap 302 may be defined in at least one of a back wall 206*c* and/or a front wall.

In some embodiments, the bottom wall 206*e* may include at least one aperture 304 (e.g., void, opening, hole, etc.). In some embodiments, the at least one aperture 304 may allow the card input portion 110 (FIG. 4) of the card-handling device 100 to interface with unshuffled cards stored within the card intake area 202, when the card intake area 202 has been rotated about axis 310 by about ninety degrees such that the gap 302 faces towards the card-shuffling mechanism, as shown in FIG. 5. For example, idler and/or pick-off rollers 610 (FIG. 8) may protrude through the at least one aperture 304 to interface with at least one card that may be resting on the bottom wall 206*e* in order to move the at least one card through the gap 302 and out of the card intake area 202.

Referring back to FIG. 5, in some embodiments, the card intake area 202 includes an open face 208 for receiving unshuffled cards. This open face 208 may face in a direction, as illustrated in FIG. 5, during card loading. During card distribution, this open face may be positioned 90 degrees from the direction illustrated in FIG. 5. In some embodiments, the open face 208 may include retention brackets 312 configured to secure the cards within the card intake area 202 during rotation of the card intake area 202. For example, the retention brackets 312 may be automated such that, when the card intake area 202 arrives in the elevated position, the retention brackets 312 may open providing a substantially enlarged area in the open face 208 for inputting unshuffled cards. Before the card intake area 202 retracts, the retention brackets 312 may close at least partially blocking the open face 208 such that the unshuffled cards when in a horizontal position cannot be inserted or removed through the open face 208. The retention brackets 312 may then secure the unshuffled cards within the card intake area 202 during the elevating and/or retracting motion of the card intake area 202, and during rotation. In some embodiments, the retention brackets 312 may be manually operated by the operator. For example, the operator may input a command into the control system 104 (FIG. 1, which may include an input and a display) to open and/or close the retention brackets 312 or the operator may directly manipulate the retention brackets 312 between open and closed or secured positions.

In some embodiments, the retention brackets 312 may have biasing elements 314 (e.g., springs, resilient members, compressible fluid, etc.) configured to bias the retention brackets 312 toward a closed position. In some embodiments, the retention brackets 312 may have an angular face 316, such that, when the operator inserts the unshuffled cards between the retention brackets 312 the retention brackets 312 are forced into an open position by the interface between the unshuffled cards and the angular face 316 of the retention brackets 312. The biasing elements 314 may return the retention brackets 312 to a closed position after the unshuffled cards have passed through the open face 208 between the retention brackets 312.

In some embodiments, the card intake area 202 may include a rotational input 308 (e.g., spindle, gear, shaft, differential, motor, gearbox, or cog). The rotational input 308 may be configured to rotate the card intake area 202 about a vertical axis 310 of the card intake area 202. In some embodiments, the vertical axis 310 may coincide with the minor axis 25 (FIGS. 1 and 2) of the unshuffled cards retained within the card intake area 202. The minor axis 25 (FIGS. 1 and 2) of the unshuffled cards may extend through a thickness of the unshuffled cards in a direction transverse to a longitudinal axis and a lateral axis of the unshuffled cards (e.g., axes extending along the major faces of the cards). For example, the thickness may extend from a front major face of the card to a back major face of the card. The minor axis in some embodiments is positioned normal to a plane that is coplanar with each card face such that when a card is rotated about the minor axis, the plane of the card face remains substantially in the same plane.

In some embodiments, the rotational input 308 may be configured to rotate the card intake area 202 when in an elevated position and/or in a retracted position. For example, the rotational input 308 may be configured to rotate the card intake area 202 while transitioning from the elevated position to the retracted position and/or while transitioning from the retracted position to the elevated position. The rotational input 308 may also be configured to rotate the card intake area 202 while in the retracted position and while cards are being transferred to the card-shuffling apparatus 114 (FIG. 4).

As depicted, the rotational input 308 may be a gear (e.g., cog, spline, helical gear, tapered gear, etc.). In some embodiments, the rotational input 308 may remain disengaged when the card input area 202 is not in the retracted position. For example, the rotational input 308 may engage a rotational drive 502 (FIG. 7) (e.g., actuation system, motor and input gear, gearbox, clutch, electronic spindle, etc.) at the retracted position where the rotational drive 502 (FIG. 7) may drive the rotational input 308 rotating the card input area 202.

In other embodiments, the rotational input 308 may be remain engaged (e.g., be permanently engaged) with a gearbox configured to input rotation into the rotational input 308 in the elevated position, the retracted position or at any point during the transition between the elevated position and/or the retracted position.

In other embodiments, the rotational input 308 may include any type of linkage. For example, the rotational input 308 may be formed as a shaft (e.g., a keyed shaft) with one or more discontinuous sides (e.g., linear sides) that may engage with a complementary opening to link the shaft to the rotational drive 502. In this and other embodiments, the linkage of the rotational input 308 may engage and disengage from the rotational drive 502 or may remain constantly engaged.

Figure 6:
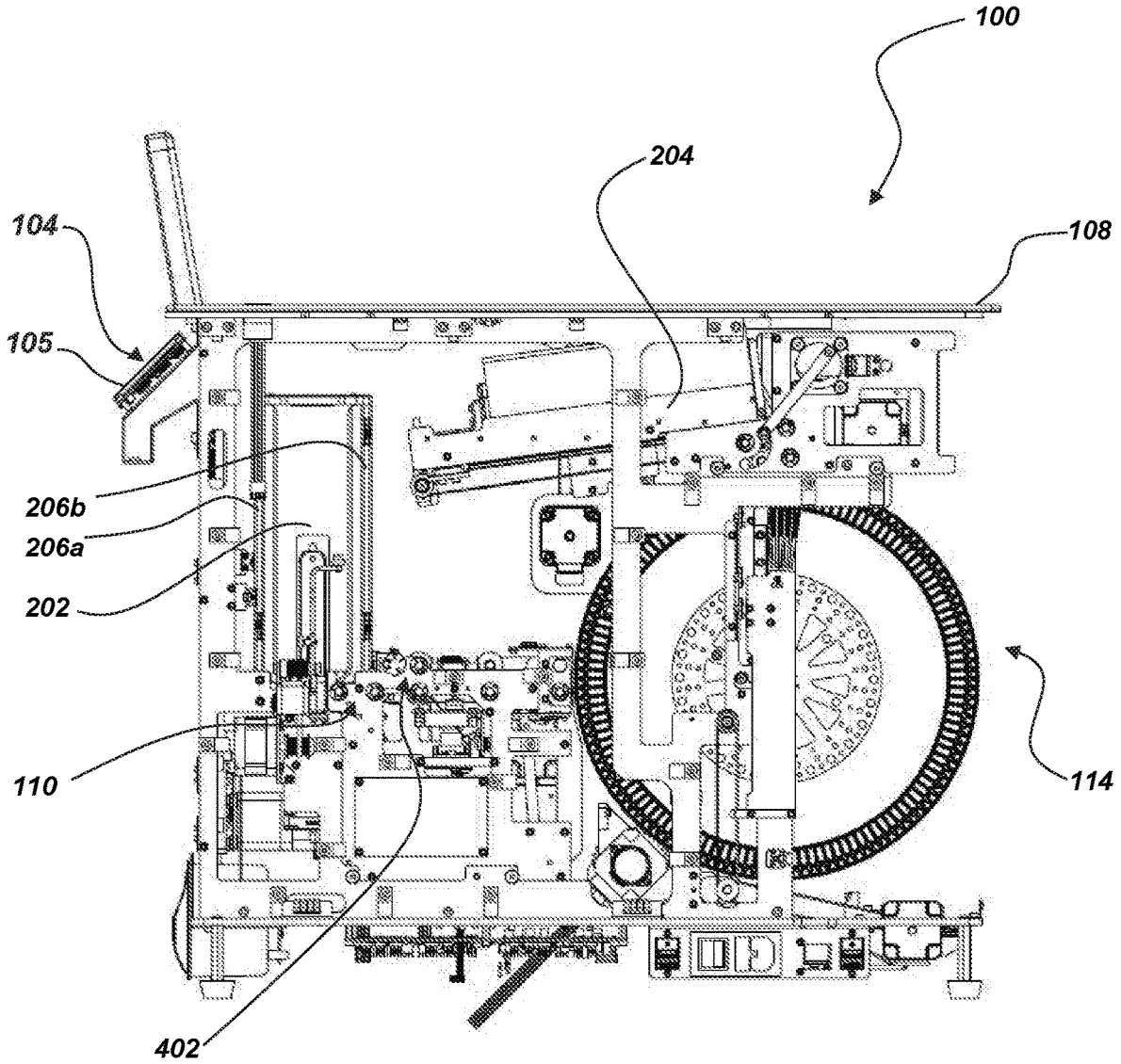
FIG. 6 shows an elevational side view of an embodiment of the present disclosure with covers removed to show the internal mechanism.

FIG. 6 shows an elevational side view of the card-handling device 100 with the card intake area 202 in a retracted position within the card-handling device 100. In some embodiments, the card intake area 202 may rotate such that, in the retracted position, the sidewalls 206*a*, 206*b* are in a front and back location relative to the card-handling device 100. For example, the card intake area 202 may rotate at least 90°, such as, for example, ±90°, ±270° as the card intake area 202 retracts into the retracted position and/or after the card intake area 202 is in the retracted position. In some embodiments, when the card intake area 202 is in the retracted position the card intake area 202 may be integrated into the card input portion 110. In some embodiments, the card input portion 110 may include a first card feed system 402 configured to transport the playing cards from the card intake area 202 to the card-shuffling apparatus 114.

The playing cards may exit the card intake area 202 through the one of the gaps 302 (FIG. 5) in the sidewalls 206*a*, 206*b* (e.g., the gap 302 facing a first card feed system 402 leading to a shuffling apparatus). The card intake area 202 may rotate at least 180° after one or more playing cards are removed from the card intake area 202, altering which sidewall 206*a*, 206*b* and corresponding gap 302 is facing the first card feed system 402. For example, a selected number of playing cards may be removed from the card intake area 202 through the gap 302 in sidewall 206*a*. After the one or more playing cards are removed from the card intake area 202, the card feed system 402 may pause to allow the intake area 202 to rotate 180° such that sidewall 206*b* is facing the first card feed system 402. When the sidewall 206*b* is facing the first card feed system 402, the feed system 402 may resume operation, and an additional card or cards may be removed through the gap 302 in the sidewall 206*b*. As discussed below in greater detail, such a configuration may be utilized to at least partially randomize a side or edge of the cards as they appear on one side of a group of cards (e.g., a leading edge of the card that is visible to players as it protrudes out of a card shoe).

In some embodiments, the playing cards may be rotated individually. For example, the card intake area 202 may rotate at least 180° after each playing card is removed from the card intake area 202. In some embodiments, the playing cards may be rotated randomly. For example, a selector (e.g., random number generator) in the form of a program, algorithm, circuit, etc., may generate a random number after the card intake area 202 is rotated. After the random number of playing cards is removed from the card intake area 202, the card intake area 202 may rotate at least 180° and a new random number may be generated. In some embodiments, the playing cards may be rotated pseudo-randomly. For example, a program, algorithm, and/or circuit may be configured to output different numbers in a preconceived series or pattern. A new number may be output each time the card intake area 202 rotates. The card intake area 202 may rotate each time the number of playing cards is removed from the card intake area 202. In some embodiments, the playing cards may be rotated in sets or batches according to at least one predetermined formula or algorithm. For example, the card intake area 202 may rotate at least 180° and remove a first number of cards (e.g., one card) from the card intake area 202, rotate at least 180° and remove a second number of cards (e.g., four cards) from the card intake area 202, and repeat or continue on in a selected or randomized pattern. In another example, the card intake area 202 may rotate at least 180° and remove three cards from the card intake area 202, rotate at least 180° again and remove ten cards from the card intake area 202, and repeat. In another example, the card intake area 202 may rotate at least 180° and remove one card from the card intake area 202, rotate at least 180° and remove X+3 cards from the card intake area 202, where X is the total number of cards removed from the card intake area 202 in the previous position.

In some embodiments, the card intake area 202 may be configured to rotate a specified number of times during each shuffling cycle (e.g., at an interval comprising a number of cards delivered and/or a duration of time). For example, the specified number of times the card intake area 202 rotates may be selected based on the number of playing cards in the card intake area 202. In some embodiments, the specified number of rotations may be input by a user. In other embodiments, the specified number of rotations may be randomly selected from a range of numbers. For example, the range of numbers may be between 1 and 20 rotations for each shuffling cycle. In some embodiments, an interval between rotations may be substantially equal for each rotation. In some embodiments, the interval between rotations change for each rotation. For example, the interval between rotations may change randomly or pseudo-randomly through algorithms, programs, circuits, random number generators, etc.

If the sets or batches of cards between rotations of the card intake area 202 become too large, the rotated favorable cards may still be detectable as being inconsistent from the surrounding cards. Reducing the number of cards removed in each batch may further frustrate the efforts of an edge cheater. In some embodiments, the number of playing cards removed in each position or batch may be limited. For example, the number of playing cards that may be removed from the card intake area 202 before the card intake area 202 rotates may be limited to less than about twenty playing cards, such as between about one playing card and about fifteen playing cards or between about two playing card and about ten playing cards.

Figure 7:
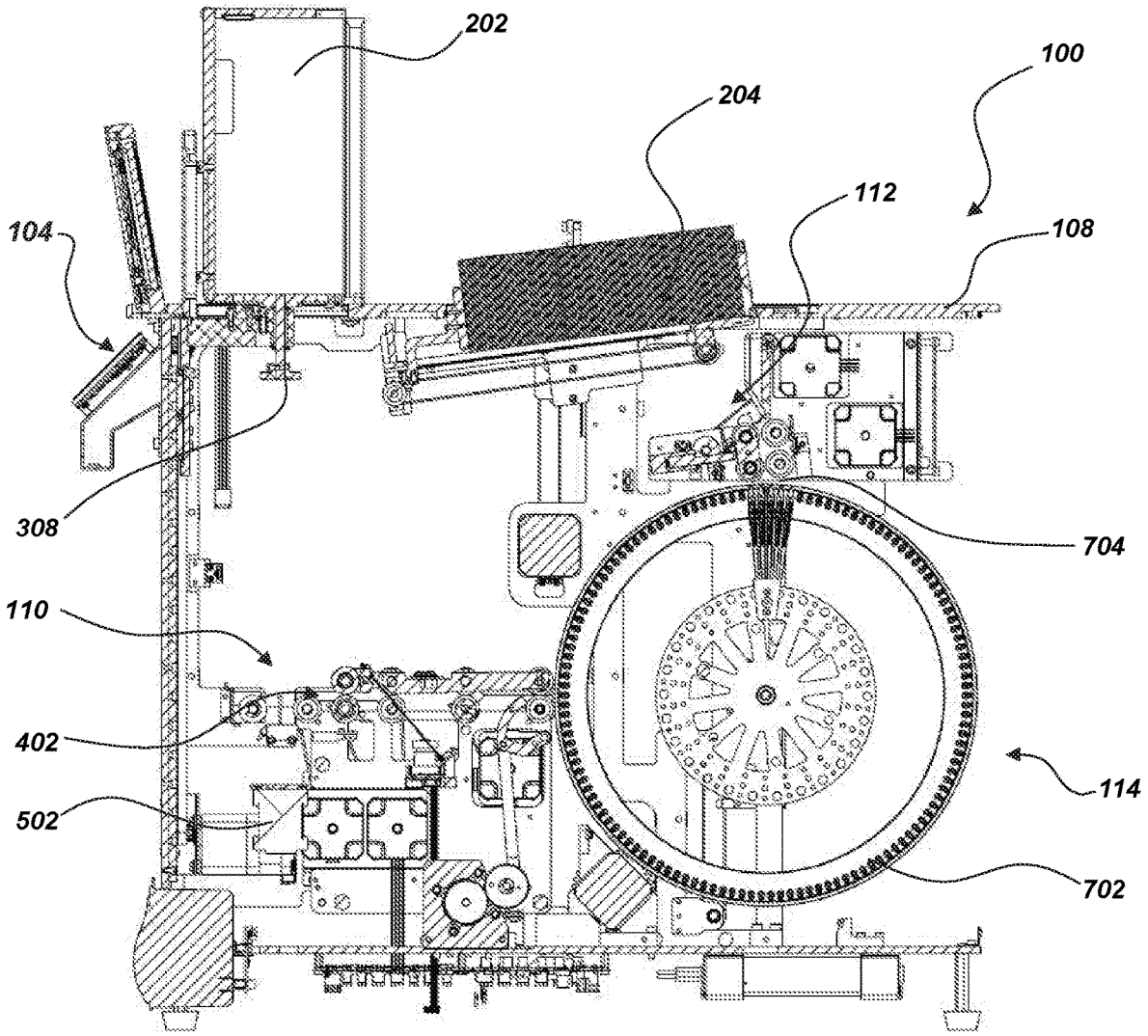
FIG. 7 show a section view of an elevational side view of an embodiment of the present disclosure with shuffled cards in the card outlet delivery area.

FIG. 7 is an elevational side section view of the card-handling device 100 with both the card intake area 202 and the card outlet 204 in the elevated position. As depicted, the rotational drive 502 for the card intake area 202 may remain integral to the other components of the card input portion 110, such as the first card feed system 402. The rotational drive 502 may only engage the rotational input 308 when the card intake area 202 is in the retracted position. In some embodiments, the first card feed system 402 may be substantially aligned in a substantially horizontal plane. For example, the playing cards may exit the card intake area 202 in a substantially horizontal plane and may continue through the first card feed system 402 and into the card-shuffling apparatus 114 in the same substantially horizontal plane.

Figure 8:
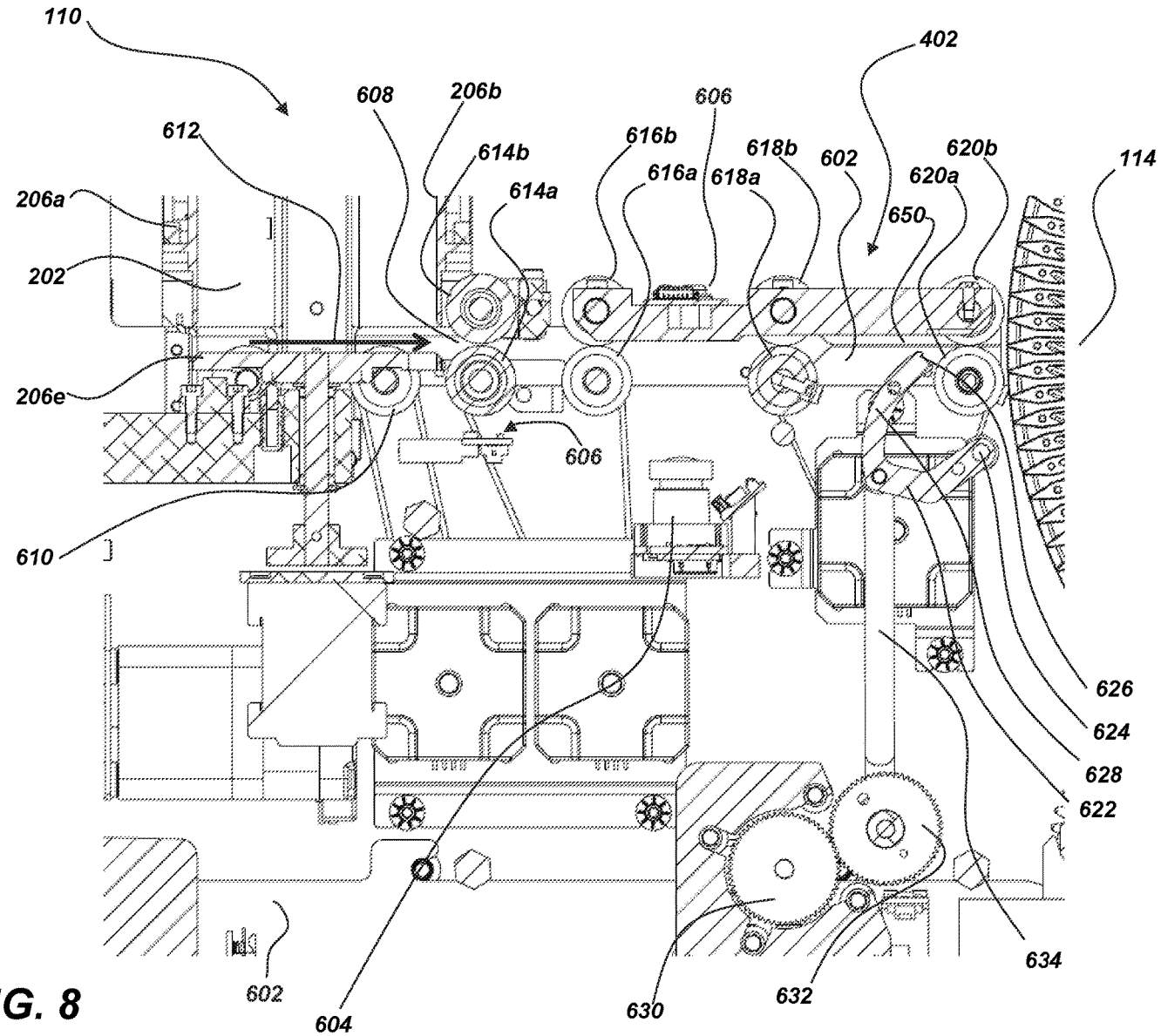
FIG. 8 shows an enlarged view of a section view of a card input portion according to an embodiment of the present disclosure.

FIG. 8 shows an enlarged view of the card input portion 110 from the side section view of the card-handling device 100. The card input portion 110 may include the first card feed system 402, a first frame assembly 602, a card-imaging system 604, and one or more sensors 606. The first card feed system 402 may include a first card pathway 608 (e.g., pathway along which playing cards move through the card input portion 110). The first card pathway 608 may lead from the card intake area 202 of the card input portion 110 to the card-shuffling apparatus 114 (e.g., a carousel). The first card feed system 402 may include a set of pick-off rollers 610 that may transport playing cards individually from the card intake area 202 to the first card pathway 608 in a direction indicated by arrow 612. In some embodiments, the pick-off rollers 610 may protrude through the at least one aperture 304 (FIG. 5) in the bottom wall 206*e* of the card intake area 202. The pick-off rollers 610 may remove the playing cards individually from a bottom area of the card intake area 202 through the gaps 302 (FIG. 5) in the sidewalls 206*a*, 206*b*. Additional pairs of rollers 614*a*, 614*b*, 616*a*, 616*b*, 618*a*, 618*b*, 620*a*, and 620*b* may act to displace playing cards from the card intake area 202 to the card-shuffling apparatus 114 (e.g., one card at a time). For example, a stack of unshuffled playing cards may be placed in the card intake area 202, and the set of pick-off rollers 610 of the first card feed system 402 may remove playing cards (e.g., individually) from a bottom of (e.g., beneath) the stack of unshuffled playing cards and pass the playing cards to the additional pairs of rollers 614*a*, 614*b*, 616*a*, 616*b*, 618*a*, 618*b*, 620*a*, and 620*b*, some of which may be brake rollers. The additional pairs of rollers 614*a*, 614*b*, 616*a*, 616*b*, 618*a*, 618*b*, 620*a*, and 620*b* may transport the playing cards to the card-shuffling apparatus 114. As discussed above, the card intake area 202 may be configured to receive one or more decks of playing cards (e.g., one, two, four, six, eight, ten decks of cards, etc.) at a time.

In some embodiments, the card-imaging system 604 may be oriented along the first card pathway 608 of the first card feed system 402. The first card feed system 402 may transport playing cards past the card-imaging system 604, and the card-imaging system 604 may capture identifying information of each playing card as each playing card moves along the first card pathway 608 before insertion into the card-shuffling apparatus 114. For example, the card-imaging system 604 may include a camera or line scanning device that captures an image or scan of each card. In some embodiments, the card-imaging system 604 may comprise one or more of the imaging devices described in U.S. Pat. No. 7,933,448 to Downs, issued Apr. 26, 2011, in U.S. Pat. No. 7,764,836 to Downs et al., issued Jul. 27, 2010, or in U.S. Pat. No. 8,800,993 B2 to Blaha et al., issued Aug. 12, 2014, the disclosure of each of which is incorporated herein in its entirety by this reference. In some embodiments, the card-imaging system 604 may not need to capture an image of an entire card, but may detect only rank and suit information, indicia (e.g., markings) on the playing cards, such as, for example, a lot number, a casino identifier, a shoe number, a shift number, a table number, bar code, glyph, any other known type of special marking, or combinations thereof. In some embodiments, the control system 104 (FIG. 3) of the card-handling device 100 may receive signals from the card-imaging system 604 to determine rank and/or suit of each playing card being read or sensed by the card-imaging system 604. The control system 104 (FIG. 3) of the card-handling device 100 may store at least some data related to each playing card (e.g., an inventory of the playing cards handled by the card-handling device 100, a complete card set composition, etc.) in a memory portion of the control system 104 (FIG. 3). Stored data may be compared to data collected at the card-imaging system 604 or another location in the card-handling device 100. For example, the card-imaging system 604 may be used in conjunction with a second card-imaging system that may capture the same information in another location (e.g., the card-shuffling apparatus 114, an associated card-dispensing device, such as a shoe) or with stored values from a previous imaging event to keep an inventory of the playing cards and/or verify the constitution of a group of cards.

In some embodiments, the one or more sensors 606 of the card input portion 110 may be oriented proximate the card intake area 202 and may be used to sense whether playing cards are present in the card intake area 202 or whether playing cards are being passed from the card intake area 202 to the first card pathway 608. Furthermore, the sensor 606 may be configured to send signals to the control system 104 (FIG. 3) and inform the control system 104 (FIG. 3) that playing cards are present in the card intake area 202. Furthermore, the control system 104 (FIG. 3) may be configured to initiate a shuffling cycle (e.g., process of shuffling playing cards with the card-handling device 100) when the card intake area 202 is in the retracted position and the sensor 606 detects the presence of cards in the card intake area 202. In some embodiments, the sensor 606 may include at least one of an optical sensor and an infrared sensor.

In some embodiments, the card input portion 110 may include a restricted portion 650 of the first card pathway 608. For example, the restricted portion 650 may restrict a lateral and/or longitudinal dimension of the card pathway 608 in order to restrict unwanted movement (e.g., bending) of the cards as they moved toward and into the card-shuffling apparatus 114.

In some embodiments, the card input portion 110 may include an elongated packer arm 622. The elongated packer arm 622 may rotate about a packer arm shaft 624 and a pushing surface 626 of a pusher arm 628 of the elongated packer arm 622 may translate partially along the first card pathway 608 of the first card feed system 402 to ensure proper loading of the playing cards into the card-shuffling apparatus 114. A motor 630 may rotate an eccentric cam member 632, which may, cause the elongated packer arm 622 to rock back and forth along an arc-shaped path through a connector link 634.

In some embodiments, the elongated packer arm 622 may be used to provide additional force to a trailing end of a playing card along the first card pathway 608 as the playing card leaves the pair of rollers 620*a*, 620*b*. For example, the elongated packer arm 622 may be located in the card-handling device 100 such that the pushing surface 626 of the pusher arm 628 of the elongated packer arm 622 may abut against a trailing edge of a playing card and force the playing card at least substantially completely into the card-shuffling apparatus 114. In some embodiments, the elongated packer arm 622 may be similar to the devices disclosed in the aforementioned U.S. Pat. Nos. 6,659,460, 7,766,332, and 8,800,993 B2, the disclosures of each of which are incorporated herein in their entireties by this reference.

Figure 9:
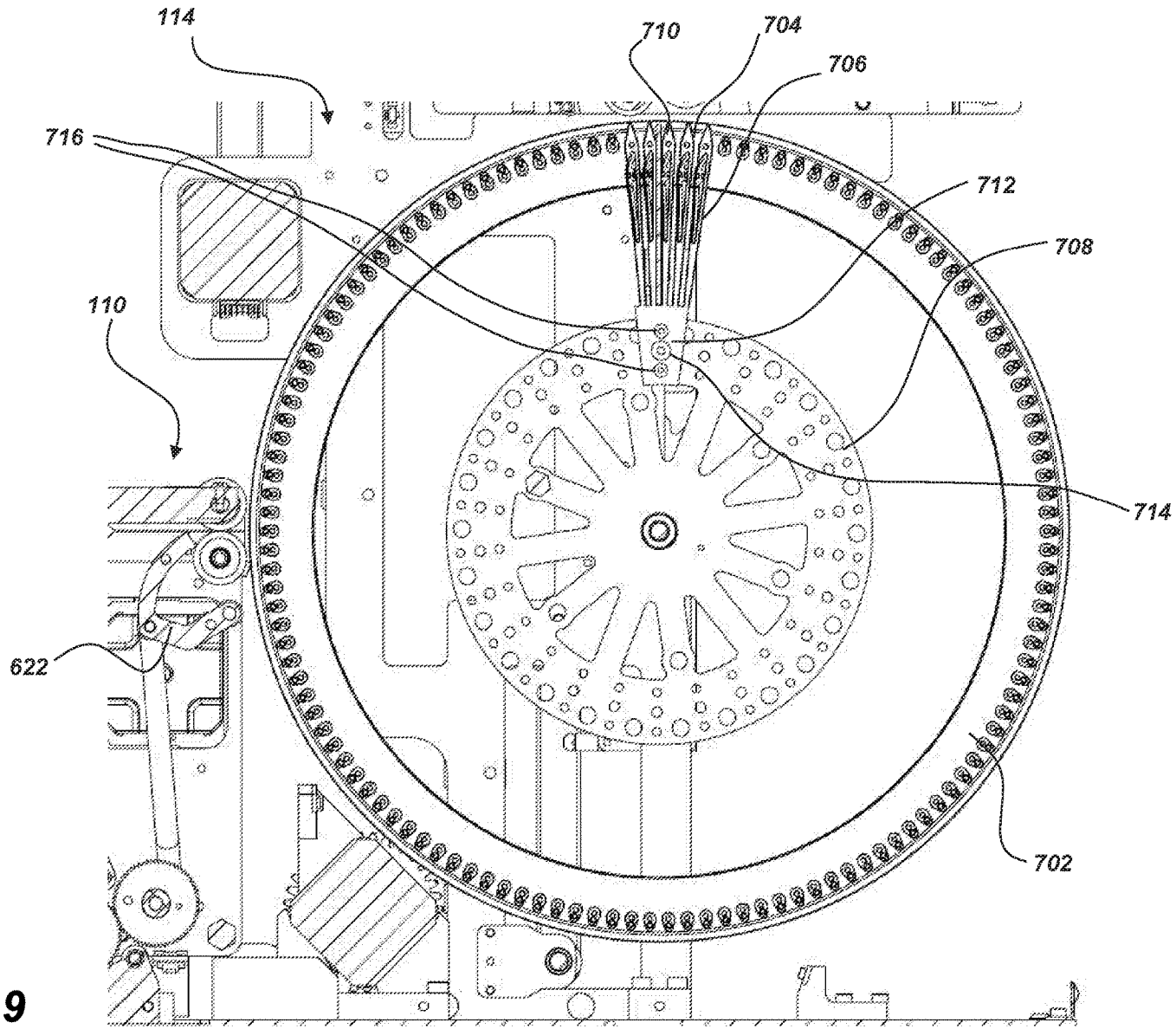
FIG. 9 shows an enlarged view of a section view of a card-shuffling apparatus according to an embodiment of the present disclosure.

FIG. 9 shows an enlarged view of the card-shuffling apparatus 114 from the cross-sectional side view of the card-handling device 100 of FIG. 7. In some embodiments, the card-shuffling apparatus 114 may include a multi-compartment carousel 702 and the packer arm 622. The multi-compartment carousel 702 may be circular in shape (e.g., annular). The multi-compartment carousel 702 of the card-shuffling apparatus 114 may have a number of compartments 704 (e.g., apertures, securing portions, etc.) defined between spaced pairs of adjacent fingers 706 (e.g., adjacent arms, etc.) extending from a rotatable center member 708. Each compartment 704 may be defined between two spaced pairs of adjacent fingers 706 of the multi-compartment carousel 702. The fingers 706 may each include a beveled edge 710 that enables and guides insertion of playing cards on top of or below playing cards previously deposited in the compartments 704 by the first card feed system 402 (FIG. 8) of the card input portion 110. The beveled edges 710 may include flat, angled surfaces or curved surfaces. Card edges of playing cards may contact the beveled edges 710 and may be deflected and guided into the compartments 704.

In some embodiments, the adjacent fingers 706 may include a biasing element (e.g., spring, leaf spring, inverted spring, inverted leaf spring, resilient member, etc.) providing biasing pressure between the adjacent fingers 706 for assisting in holding playing cards securely within the compartments 704 after the playing cards are inserted into the multi-compartment carousel 702. In some embodiments, each compartment 704 may be sized and shaped to hold between one and ten playing cards, such as between two and seven playing cards, between one and five playing cards or between four and five playing cards.

In some embodiments, the multi-compartment carousel 702 may have between about eighty or one-hundred compartments and about two-hundred compartments, such as between about one-hundred compartments and about one-hundred-sixty compartments, between about one-hundred-twenty compartments and about one-hundred-forty compartments, or about one-hundred-thirty compartments. In some embodiments, the multi-compartment carousel 702 may be configured to hold up to six-hundred-fifty individual cards, such as between about fifty cards and about six-hundred-fifty cards, between about five-hundred cards and about six-hundred cards, or about five-hundred-twenty cards.

In some embodiments, the compartments 704 may be modular. For example, the multi-compartment carousel 702 may be defined by a number of compartment modules 712 extending radially from the rotatable center member 708. In some embodiments, the compartment modules 712 may be individually removable from the rotatable center member 708. For example, each compartment module 712 may be secured to the rotatable center member 708 with hardware (e.g., screws, bolts, nuts, studs, pins, etc.), clamps (e.g., toggle clamps, latch clamps, spring clamps, screw clamps, etc.), or latches (e.g., draw latch, pin and tube latch, toggle latch, barrel latch, rotary latch, etc.).

The compartment modules 712 may be coupled to center member 708 by one or more fasteners 714 (e.g., bolts, screws, etc.). In some embodiments, the compartment modules 712 may include one or more adjustment features 716 that may be utilized to alter the orientation of the compartment modules 712 relative to adjacent compartment modules 712 and/or relative to the center member 708. For example, the compartment modules 712 may include two adjustment features 716 (e.g., two screws) that alter the orientation of the compartment modules 712 relative to the center member 708 by contacting the center member 708 and pushing the compartment modules 712 in one or more directions. Such adjustment features 716 may be utilized to align each compartment module 712 relative to adjacent compartment modules 712 along the circumference of the multi-compartment carousel 702 (e.g., axially align the compartment modules).

Figure 10:
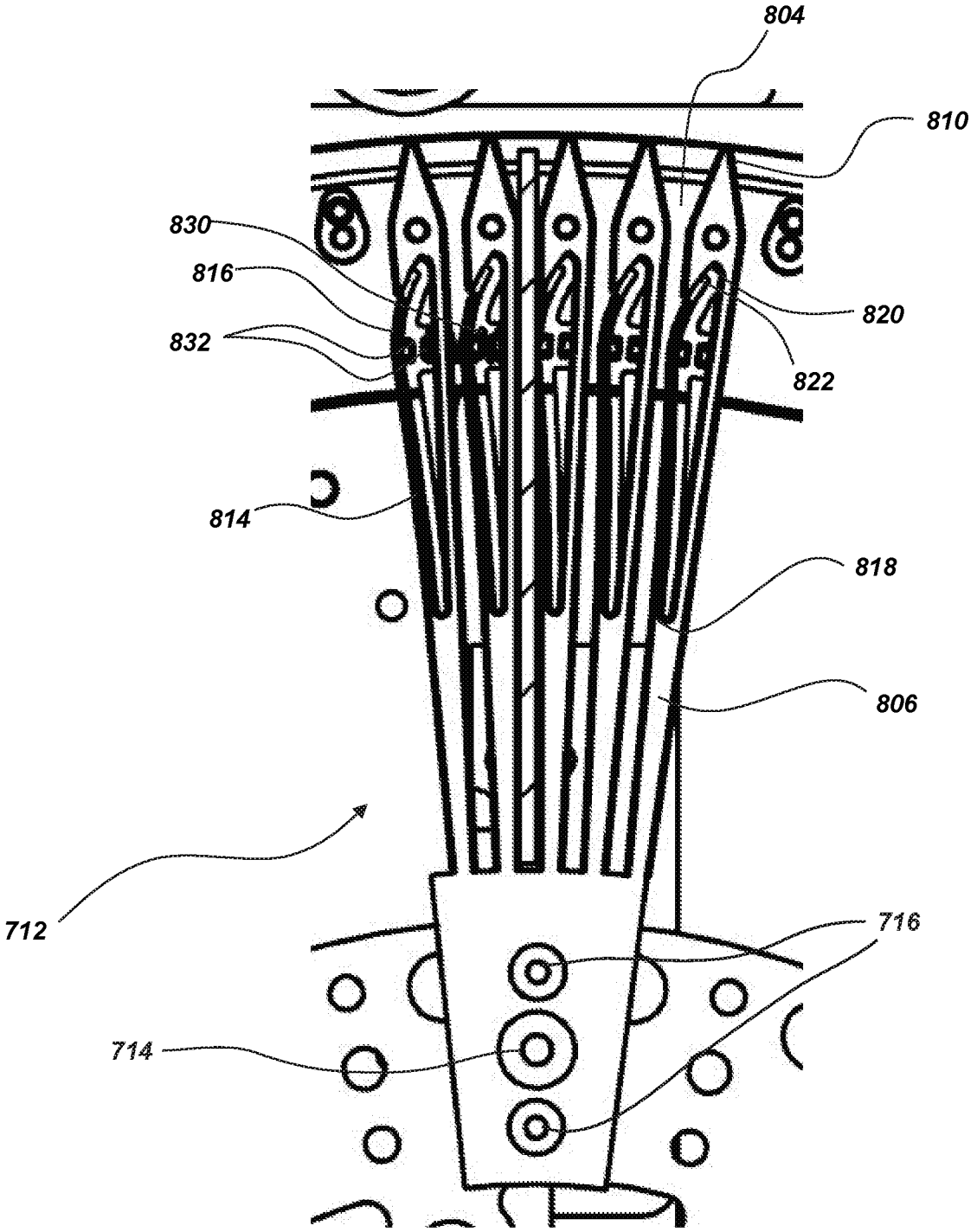
FIG. 10 shows an enlarged view of a compartment module according to an embodiment of the present disclosure.

FIG. 10 shows an enlarged view of a compartment module 712 of the multi-compartment carousel 702 of FIG. 9. In some embodiments, the compartment module 712 may include at least one aperture 804 defined between at least two arms 806. In some embodiments, the arms 806 may have a beveled leading edge 810 configured to guide playing cards into the apertures 804 between the arms 806.

In some embodiments, the arms 806 may include a biasing element 814 configured to secure the playing cards within the apertures 804. In some embodiments, the biasing element 814 may be formed from a resilient material configured to bow at least partially outward from the arm 806 intruding into the aperture 804. For example, the biasing element 814 may be a length of resilient material forming an arc with an apex 816 of the arc located within the aperture 804 in a direction away from the arm 806. In some embodiments, the biasing element 814 may be separate from the arm 806. The arm 806 may include a bottom retention 818 and a top retention 820 configured to retain the ends 822 of the biasing element 814. In some embodiments, the biasing element 814 may be a resilient material spanning between the top retention 820 and the bottom retention 818. In some embodiments, at least one of the top retention 820 and the bottom retention 818 may be configured to provide a floating retention of the biasing element 814 such that an end of the biasing element 814 may move relative to the arm 806. For example, the distal end 822 of the biasing element 814 may move inward away from the aperture 804 while still being restricted from moving outward into the aperture 804 beyond a selected distance. When the biasing element 814 is fully extended such that an apex 816 of the biasing element 814 is the largest distance from the arm 806, as permitted by the arms 806, the distal end 822 may be in a first position within the top retention 820. When playing cards are inserted into the aperture 804, the apex 816 may move toward the arm 806 and the floating retention in the top retention 820 may allow the distal end 822 of the biasing element 814 to move to a second position.

In some embodiments, at least one of the bottom retention 818 and the top retention 820 may be a fixed connection such that an end of the biasing element 814 in the bottom retention 818 and/or the top retention 820 may not be allowed to move relative to the arm 806. In some embodiments, the biasing element 814 may be integral to the arm 806 (e.g., formed from the same piece of material such that there is no definitive joint between the biasing element 814 and the arm 806) at the fixed connection. In some embodiments, the biasing element 814 may be formed from a different material and fixed to the arm 806 at the bottom retention 818 and/or the top retention 820. The biasing element 814 may be attached with hardware (e.g., pin, screw, bolt, etc.), adhesive (e.g., glue, epoxy, etc.), welding, soldering, or brazing.

In some embodiments, one of the bottom retention 818 and the top retention 820 may be a fixed connection while the other retention 818, 820 is a floating retention. For example, the bottom retention 818 may be a fixed connection and the top retention 820 may be a floating retention.

In some embodiments, the biasing element 814 may include a biasing support 830 (e.g., secondary biasing element, secondary spring, bump stop, damper, etc.). For example, the biasing support 830 may be positioned between the apex 816 and the arm 806. The biasing support 830 may be configured to provide additional support to the biasing element 814. In some embodiments, the biasing support 830 may be adjustable such that the securing pressure of the biasing element 814 and/or the biasing support 830 may be adjustable, such as, for example, by limiting the travel of the biasing element 814, increasing the resistance by preloading the biasing support (e.g., spring spacers, indexed seats, etc.), and/or otherwise altering the resistance of the biasing support (e.g., fluid pressure, damper valve adjustments, etc.). In some embodiments, the biasing support 830 may be a coil spring. In some embodiments, the biasing element 814 and/or the arm 806 may include seats 832 to locate or restrict movement of the biasing support 830 in at least one direction (e.g., in a lateral or axial direction). For example, the seats 832 may be pins and the biasing support 830 may define complementary geometry (e.g., hole, aperture, annular formation, etc.) to the pins such that the biasing support 830 is secured between the biasing element 814 and the arm 806.

In some embodiments, the apertures 804 may each include a sensor to determine when the aperture 804 is full (e.g., has the maximum number of playing cards it is configured to hold by sensing the position of the biasing element 814). In some embodiments, the sensor may include a pair of contacts, a magnetic switch, reed switch, pressure switch, proximity switch, etc. In some embodiments, the control system 104 (FIG. 3) may track the number of cards loaded into each aperture 804 and determine which apertures 804 are full based on the tracking information.

In some embodiments, the control system 104 (FIG. 3) may control which aperture 804 receives the playing cards and may determine which apertures 804 are full and which apertures 804 can receive playing cards. In some embodiments, the control system 104 may trigger the ejection of playing cards into the card output portion 112 (FIG. 4) responsive to information obtained and/or stored by the control system 104 (e.g., a record of where cards have been loaded in a shuffling event, input from the sensors, etc.). For example, the control system 104 (FIG. 3) may trigger the ejection based on a percentage of full apertures 804. In some embodiments, the control system 104 (FIG. 3) may trigger the ejection responsive to a number of full apertures 804, such as between about one-hundred full apertures 804 and about two-hundred full apertures 804, between about one-hundred twenty full apertures 804 and about one-hundred-thirty full apertures 804, or about one-hundred-twenty-five full apertures 804. In some embodiments, the control system 104 (FIG. 3) may only trigger the ejection when every aperture 804 is full. In some embodiments, the control system 104 (FIG. 3) may trigger an ejection only from an aperture 804 that is full, resulting in ejection of cards only from full apertures 804.

Although the card-handling device 100 of the present disclosure describes the card-shuffling apparatus 114 including a multi-compartment carousel 702, the card-shuffling apparatus 114 may include any suitable shuffling mechanism such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. In some embodiments, the card-shuffling apparatus 114 may have a wheel or carousel design that may be somewhat similar to the card-shuffling devices disclosed in the aforementioned and incorporated by reference U.S. Pat. No. 8,800,993 B2.

The card-shuffling apparatus 114 may operate, in at least one operational mode, as a batch shuffling machine or to verify and/or sort a group or deck of playing cards. For example, the card-shuffling apparatus 114 may be configured to shuffle a complete set or "shoe" of one or more decks of cards (e.g., one, two, four, six, eight, ten decks of cards, etc.) and then provide the cards from those decks to the dealer for insertion into a shoe.

Referring to FIGS. 6, 7, and 10, in some embodiments, the card-handling device 100 (e.g., via the capacity of multi-compartment carousel 702) may enable a sorting operation that may be performed even when a relatively large amount of cards (e.g., six decks, eight decks, ten decks, twelve decks, variations in between, or more decks of cards) are required to be sorted in the card-handling device 100. For example, the card-handling device 100 may identify and load one or more cards in each compartment 704 (e.g., one to two, three, four, five, or more cards). As one or more cards are placed in a compartment 704, the next card received (e.g., from the card intake area 202) may be placed in the currently aligned compartment 704, if the card fits the desired sorting sequence (e.g., a sequence each deck by rank and suit). If the card does not fit the desired sequence in the currently aligned compartment 704, the carousel 702 may be moved to align a compartment 704 including a card or cards that meet the desired sorting sequence or to align a new compartment lacking any cards in order to load the current card from the card intake area. In some embodiments, during the sorting process, the card-handling device 100 may offload any compartments 704 that contain cards the match the desired sequence of the cards in the card outlet 204 so that those compartment may again be utilized for new cards in the sorting. This process may continue until all cards are sorted and delivered to the card outlet 204.

If the sort was not able to be completed in a single pass (e.g., by running out of compartments 704), the card-handling device 100 may output the cards to card outlet 204 to be reloaded in the card intake area 202 so that the sort may be completed in a second pass.

Figure 11:
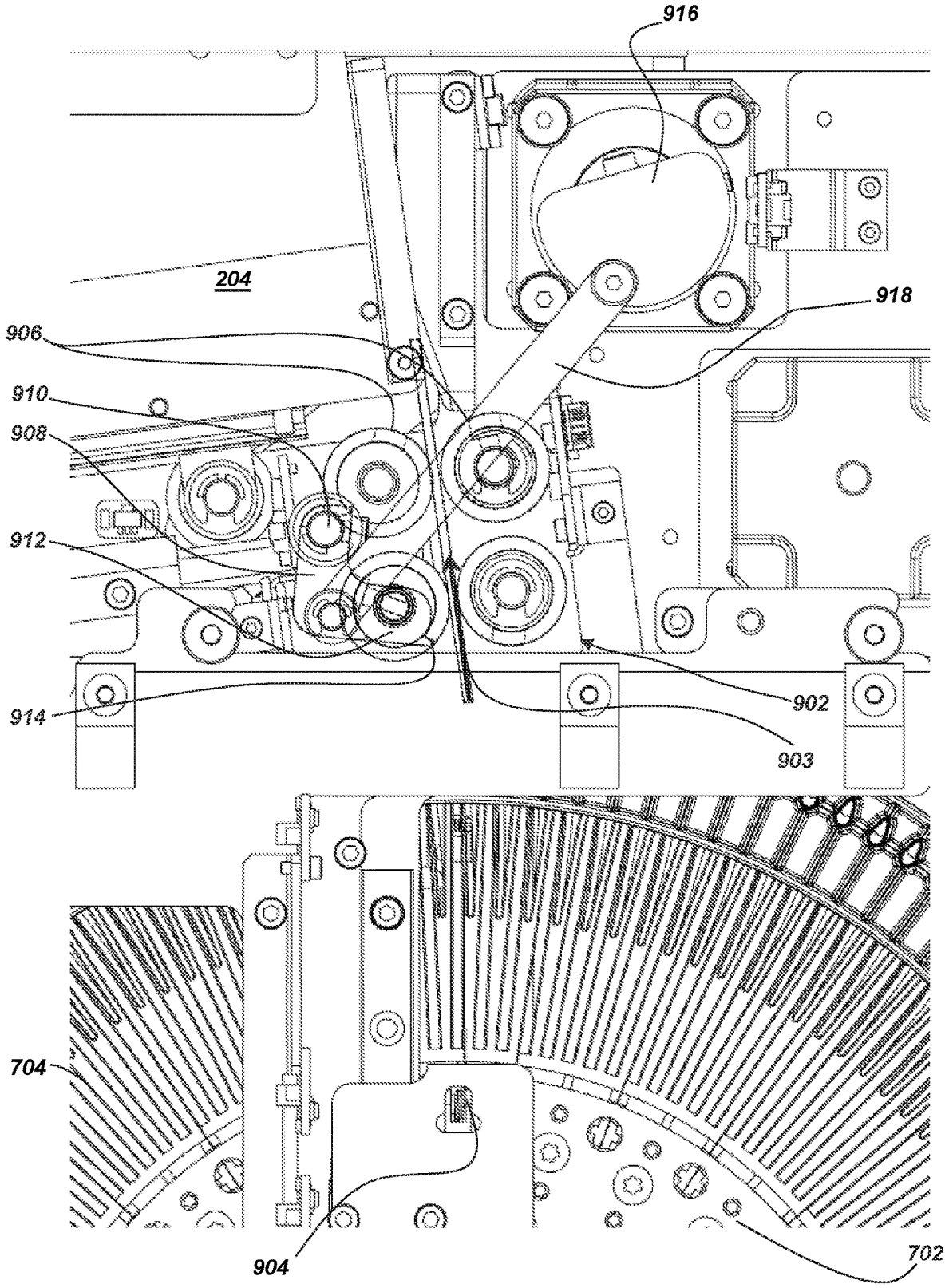
FIG. 11 shows an enlarged view of a card output portion according to an embodiment of the present disclosure with additional covers removed to show the internal mechanism.

FIG. 11 shows an enlarged view of the card output portion 112 of the card-handling device 100 (FIG. 3). A card transfer system 902 of the card-shuffling apparatus 114 may transfer playing cards from the multi-compartment carousel 702 to the card outlet 204 of the card output portion 112 of the card-handling device 100 along a second card pathway 903 when the card outlet 204 is in the retracted position. In some embodiments, the multi-compartment carousel 702 may include an ejector 904. The ejector 904 may be configured to unload groups of cards from the compartments 704 as a set into the card transfer system 902, unless there is only one card in the compartment, and then only one card is unloaded. The ejector 904 may be configured to unload the compartments 704 sequentially in a compartment 704 by compartment 704 manner. For example, the ejector 904 may unload a first compartment 704 completely before unloading a second compartment 704. In some embodiments, the second compartment 704 may be a compartment 704 adjacent to the first compartment 704. In other embodiments, the second compartment 704 may be a randomly selected compartment 704 and may not be a compartment 704 adjacent to the first compartment 704. In some embodiments, the ejector 904 may not unload the compartments 704 in a compartment 704 by compartment 704 manner. Rather, the ejector 904 may unload playing cards from the compartments 704 in a randomized (e.g., non-sequential) order. The ejector 904 may unload fewer than all cards in a compartment 704 at the same time. For example, the ejector 904 may unload one or more playing cards from a first compartment 704 without unloading other playing cards in the first compartment 704 and then may unload one or more playing cards from a second compartment 704 (e.g., with or without unloading other playing cards in the second compartment 704). In some embodiments, the ejector 904 may unload the playing cards one-at-a-time. In other embodiments, the ejector 904 may unload multiple playing cards at a time.

In some embodiments, the ejector 904 and the card transfer system 902 may be located at a top portion of the multi-compartment carousel 702. For example, the ejector 904 may unload playing cards into the card transfer system 902 when the compartment 704 retaining the playing cards is in a substantially vertical orientation within the multi-compartment carousel 702. In some embodiments, the ejector 904 and card transfer system 902 may be located about 90° of rotation about the axis of the multi-compartment carousel 702 from the first card feed system 402 (FIG. 8) such that the cards being unloaded from the compartments 704 are in an orientation transverse to an orientation of the cards when they are inserted into the compartments 704.

In some embodiments, the card transfer system 902 may include a plurality of rollers 906. The rollers 906 may displace playing cards from the multi-compartment carousel 702 to the card outlet 204 along the second card pathway 903. In some embodiments, the card transfer system 902 may include a packer arm 908. The packer arm 908 may include a packer arm pivot 910, an extended arm 912, and a finger 914. For example, the packer arm 908 may be driven by an eccentric packer motor 916 through a connecting link 918. The packer arm 908 may rotate about the packer arm pivot 910 translating the extended arm 912 and the finger 914 partially along the second card pathway 903. In some embodiments, the finger 914 may be configured to engage with a trailing edge of a group of playing cards to ensure proper loading of the playing cards into the card outlet 204.

The packer arm 908 may be used to provide additional force to a trailing edge of one or more playing cards along the second card pathway 903 as the playing card leaves the rollers 906. For example, the packer arm 908 may be located in the card-handling device 100 such that the finger 914 of the extended arm 912 of the packer arm 908 may abut against a trailing edge of a playing card and force the playing card at least substantially completely into the card outlet 204.

As depicted, the card outlet 204 may be configured to store the playing cards 205 in a similar orientation to the orientation in which the cards leave the card-shuffling apparatus 114. The card outlet 204 may be configured to store the playing cards in a substantially horizontal stack, such that the cards are in a vertical orientation (e.g., lateral or longitudinal edges of the cards extend in a substantially horizontal direction) with each card face positioned substantially vertically (e.g., where a height of the stack of cards is slanted to extend along a major length of the card output portion 112 in a direction along the top surface 108) next to an adjacent card with the major faces of the cards lying in a plane substantially transverse to the top surface 108. The card outlet 204 may be configured to substantially support the cards on at least two sides of the cards.

As depicted, the card outlet 204 may be configured to elevate and retract above and below the top surface 108 of the card-handling device 100. For example, the card outlet 204 may retract below the top surface 108 of the card-handling device 100 to be in closer proximity to the card-shuffling apparatus 114 while cards are transferred from the multi-compartment carousel 702 to the card outlet 204. In some embodiments, the card outlet 204 may be elevated above the top surface 108 of the card-handling device 100 when it has a complete set of one or more decks of cards (e.g., one, two, four, six, eight, ten decks of cards, etc.) that may be loaded in a card-dispending device, such as, a card shoe. In some embodiments, the card outlet 204 may be elevated above the top surface 108 of the card-handling device 100 when the operator needs to enter additional cards into gameplay, such as, to load the cards in a card shoe or to deal or draw cards individually or as a group of cards. In some embodiments, the card outlet 204 may remain in the elevated position above the top surface 108 of the card-handling device 100 until the entire group of cards have been removed from the card outlet 204.

Figure 12:
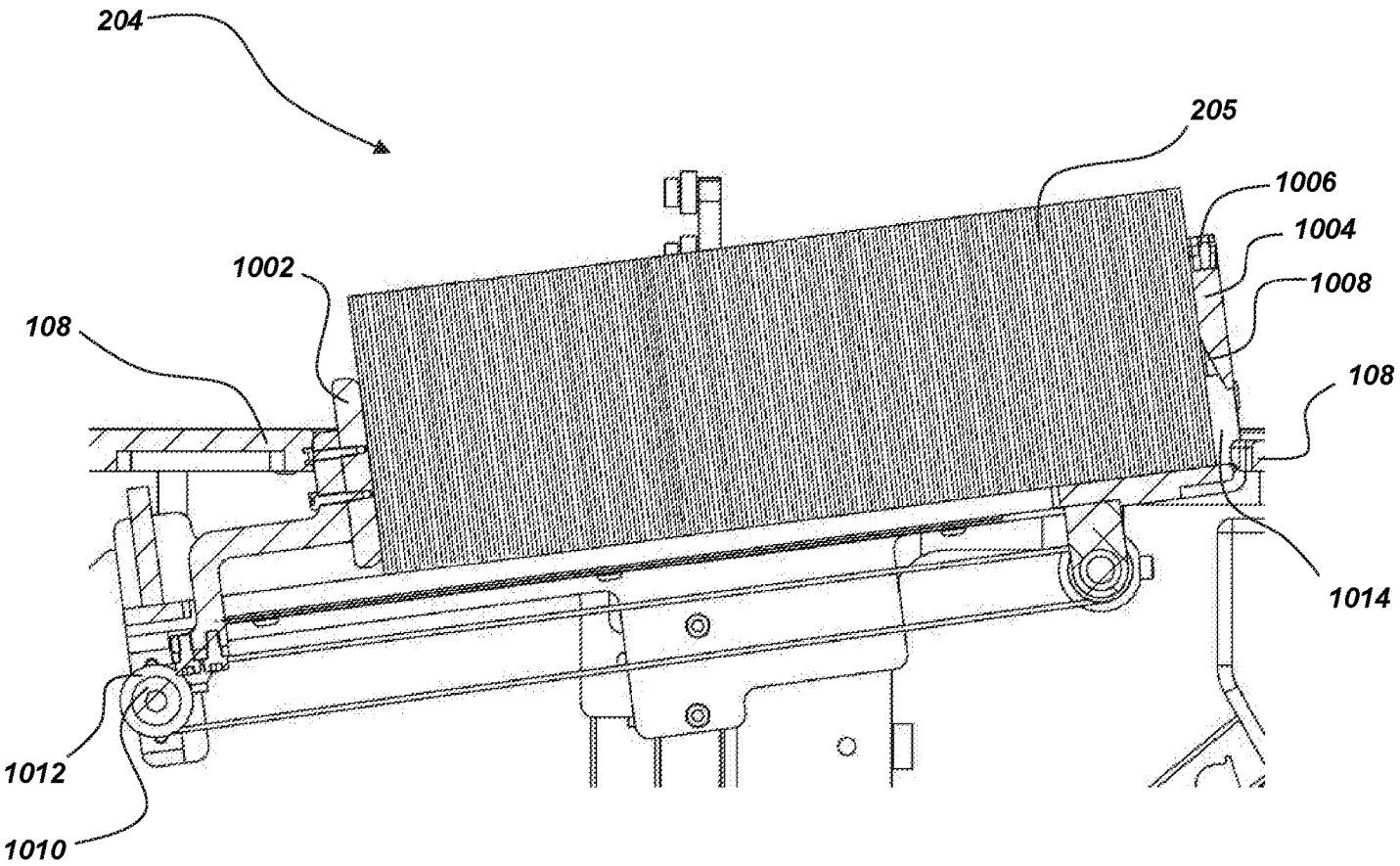
FIG. 12 shows an enlarged view of a section view of a card outlet storage container according to an embodiment of the present disclosure.

FIG. 12 shows a close up view of the card outlet 204 of the card-handling device 100. In some embodiments, the card outlet 204 may be configured to hold up to six-hundred fifty cards 205, such as between about fifty cards and about six-hundred-fifty cards, between about five-hundred cards and six-hundred cards, or about five-hundred-twenty cards (e.g., ten decks of cards).

In some embodiments, cards may be provided to the card outlet 204 (e.g., in the retracted position within the card-handling device 100 (FIG. 3)) by the card transfer system 902 (FIG. 11) may be added from an area below the card outlet 204. For example, a portion of the card outlet 204 (e.g., door or gate 1004) may define a card passage 1014 (e.g., opening, slot, etc.) in a lower portion of the gate 1004. The card passage 1014 may enable cards to pass through the card passage 1014 from the card transfer system 902 (FIG. 9) into the card outlet 204. In some embodiments, the gate 1004 may further define an angled surface 1008 configured to guide the cards being inserted through the card passage 1014 into the area within the card outlet 204. For example, the angled surface 1008 may provide a surface on which the card may slide to insert the card between a front area of the stack of playing cards 205 within the card outlet 204 and the gate 1004.

In some embodiments, the card outlet 204 may be configured to vary the internal volume of the card outlet 204. For example, the card outlet 204 may include a movable guide 1002. The movable guide 1002 may reduce the internal volume of the card outlet 204 when a number of cards to be placed in the card outlet 204 is, at least initially, less than the full capacity of the card outlet 204. The movable guide 1002 may be retracted to increase the internal volume of the card outlet 204 gradually as cards are loaded into the card outlet 204 to increase the capacity of the card outlet 204.

The card outlet 204 may be configured to present (e.g., release) a predetermined number of cards (e.g., all of the cards) to the operator such that the operator can withdraw (e.g., draw, slide, remove, etc.) the cards from the card outlet 204. For example, the card outlet 204 may include the movable guide 1002 and the gate 1004 on an end of the card outlet 204. In some embodiments, the gate 1004 may be configured to open a specified amount to enable a specific number of cards to be withdrawn past the gate 1004 (e.g., to enable an entirety of the cards 205 to slide over the gate 1004, which is substantially flush with the top surface 108 (FIG. 4) when in the open position). The gate 1004 may include a securing mechanism 1006 (e.g., a magnetic latch and a hinge) to secure the gate 1004 in place when cards are not being withdrawn. For example, a force provided by an operator sliding the cards 205 may overcome the magnetic latch and move the gate into the open, flush position. The operator may then continue sliding the cards 205 over the gate 1004 to the top surface 108 in order to further process the cards 205 (e.g., by cutting the decks of cards, moving the decks of cards into a shoe, etc.).

In some embodiments, the movable guide 1002 may be driven by a biasing element (e.g., a spring, compressible fluid, etc.). In some embodiments, the movable guide 1002 may be driven by a motor 1010. In some embodiments, the gate 1004 may displace to a position clear of a pathway (e.g., into recess 207 (FIG. 4)) upon which a stack of playing cards 205 travels to exit the card outlet 204. The motor may drive the movable guide 1002 a predetermined distance to push the cards 205 over the open gate 1004 to enable the operator to withdraw the cards. In some embodiments, where the cards 205 are removed in partial groups, the motor 1010 may act as a biasing element maintaining pressure on the movable guide 1002 such that when the gate 1004 opens and cards are withdrawn the movable guide 1002 moves the remaining cards into position for the next withdrawal.

In some embodiments, the motor 1010 may include a slip clutch 1012 (e.g., friction clutch, one-way clutch, sprag clutch, freewheel clutch, overrunning clutch, etc.) to decrease fatigue on the motor 1010 and other components when running against the closed gate 1004. In some embodiments, the slip clutch 1012 may enable the movable guide 1002 to expand the internal volume of the card outlet 204 in response to additional cards being added by the card transfer system 902 (FIG. 11) without requiring the motor 1010 to drive the movable guide 1002 in the reverse direction.

Figure 13:
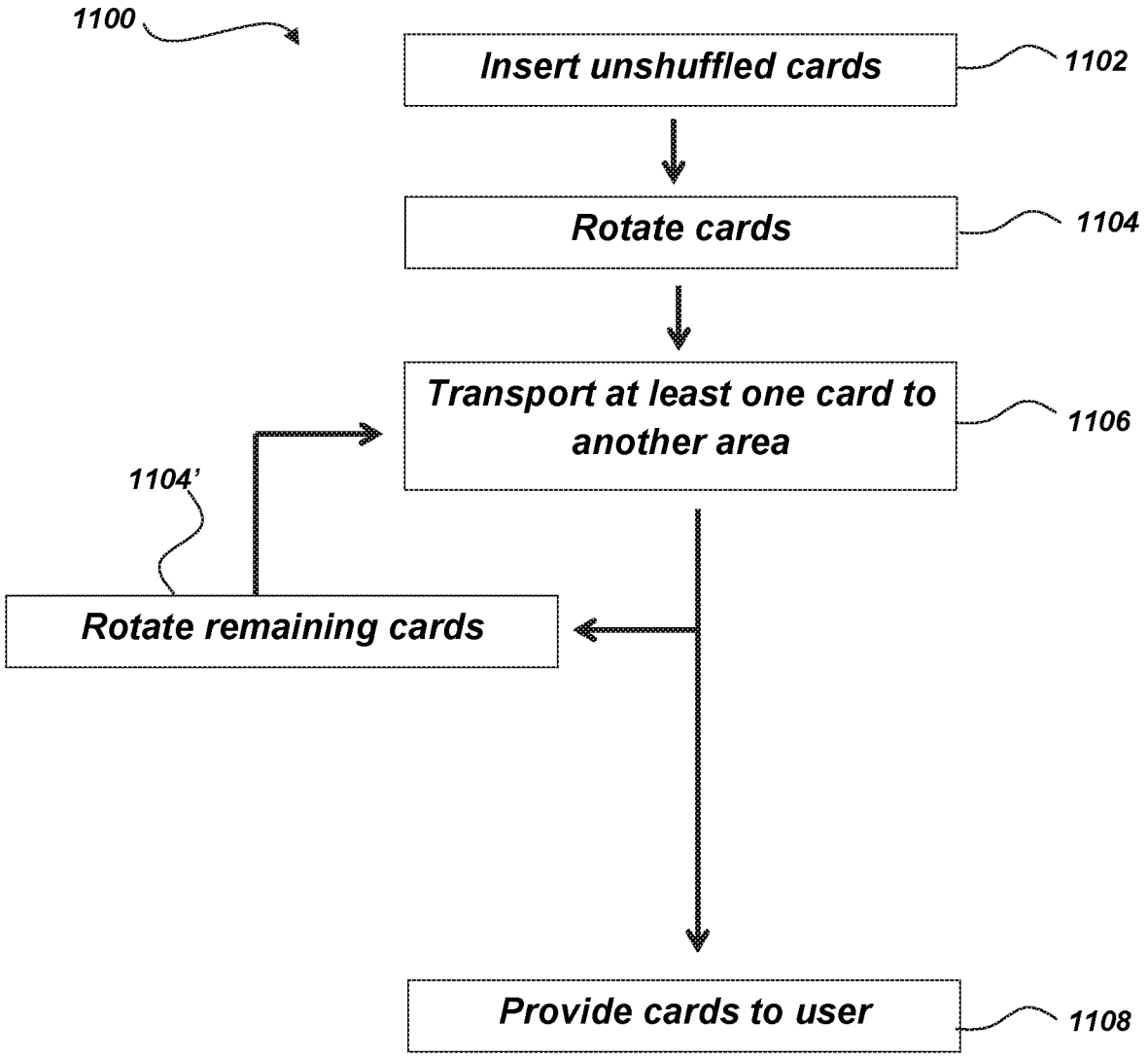
FIG. 13 is a process diagram for the shuffling of playing cards according to an embodiment of the present disclosure.

FIG. 13 shows a flow diagram of a process 1100 in which the card-handling device 100 may transport and shuffle playing cards (e.g., with the control system 104 of the card-handling device 100 controlling the process through one or more executed algorithms executed by one or more processors and/or through one or more random number generators (RNGs)). Referring to FIGS. 3 through 11 and 13 together, unshuffled playing cards may be loaded into the card intake area 202 of the card input portion 110 of the card-handling device 100, as represented in action 1102. The control system 104 of the card-handling device 100 may rotate the card intake area 202 and the playing cards housed therein such that the lateral edges of the playing cards that face the card-shuffling apparatus 114 may be altered and randomized, as represented in action 1104. For example, the control system 104 of the card-handling device 100 may rotate the card intake area 202 may intermittently rotate the card intake area 202 (e.g., as dictated by an RNG) in order to randomize the lateral edges of the cards in the stack of cards in the card intake area 202 as the cards are loaded into the card-shuffling apparatus 114. The first card feed system 402 may transport at least one playing card from the card intake area 202 to another area (e.g., another portion of the card-handling device, another device, a randomizing mechanism or shuffler, etc.), as represented by action 1106. After the at least one playing card is removed from the card intake area 202, the card intake area 202 may rotate the playing cards at least 180° such that an opposite lateral edge of the playing cards is facing the first card feed system 402, as represented in action 1104'. After the card intake area 202 has rotated in action 1104', the first card feed system 402 may transport at least one more playing card from the card intake area 202 to the other area, as represented in action 1106. In some embodiments, the actions 1104, 1104', and 1106 may be repeated (e.g., with one card or multiple cards being transferred in each act) until there are no more playing cards in the card intake area 202. In some embodiments, the actions 1104, 1104', and 1106 may be repeated until the card intake area 202 has been emptied. In some embodiments, the actions 1104, 1104', and 1106 may be repeated until an operator enters a command in the control system 104 to stop the process. Once the playing cards have been transported the playing cards may be presented to the user (e.g., dealer), as represented in action 1108.

Figure 14:
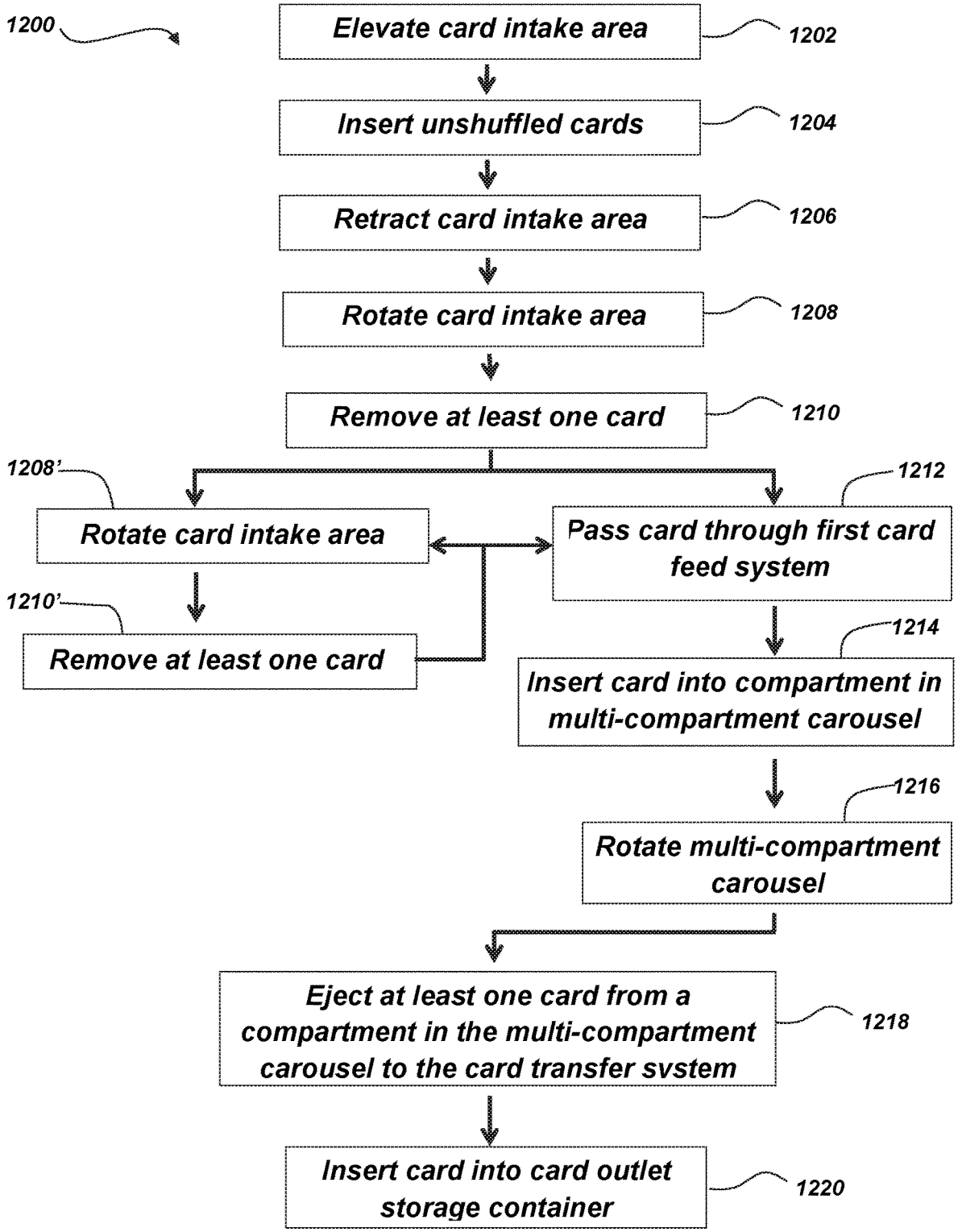
FIG. 14 is a process diagram for the shuffling of playing cards according to an embodiment of the present disclosure.

FIG. 14 shows a flow diagram of a process 1200 in which the card-handling device 100 may transport and shuffle playing cards. Referring to FIGS. 3 through 11 and 17 together, the card intake area 202 may be elevated above the top surface 108 of the card-handling device 100 to facilitate the loading of unshuffled cards, as represented in action 1202. The operator (e.g., dealer) may then load unshuffled cards into the card intake area 202, as represented by action 1204. In some embodiments, the operator may load unshuffled cards by decks (e.g., 52 cards at a time), or as an entire shoe (e.g., 2 decks, 4 decks, 6 decks, 8 decks, or 10 decks). After the unshuffled cards have been loaded into the card intake area 202, the card intake area 202 may be retracted below the top surface 108 of the card-handling device 100, as represented by action 1206.

Once the card intake area 202 is fully retracted into the card-handling device 100, the card intake area 202 may rotate until a lateral edge of the playing cards is facing the multi-compartment carousel 702, as represented by action 1208. In other embodiments, the card intake area 202 may be retracted in a position where the lateral edge of the playing cards is facing the multi-compartment carousel 702 and may not need to be initially rotated before transferring one or more cards. Once a lateral edge of the playing cards is facing the multi-compartment carousel 702, the pick-off rollers 610 may remove at least one card from the card intake area 202, as represented in action 1210. The pick-off rollers 610 may transfer the removed card to the first card feed system 402, which may transport the at least one card from the card intake area 202 to the multi-compartment carousel 702, as represented in action 1212.

The elongated packer arm 622 may move the at least one card from the first card feed system 402 into a compartment 704 of the multi-compartment carousel 702, as represented in action 1214. The multi-compartment carousel 702 may rotate moving the compartment 704 with at least one card in it to another location and presenting a new compartment 704 in the area of the elongated packer arm 622, as represented in action 1216. In some embodiments, the multi-compartment carousel 702 may rotate after each card is placed into a compartment 704. In some embodiments, the multi-compartment carousel 702 may only rotate after the compartment 704 is full. In some embodiments, the multi-compartment carousel 702 may rotate at random times (e.g., sometimes taking one card in each compartment 704 and other times taking more than one card in the compartment 704 before rotating). For example, the control system 104 may select a compartment 704 in which to load a card based on output from an RNG. If the selected compartment 704 has already reached a selected number of card in the compartment 704 (e.g., the compartment is full), the control system 104 may select another compartment 704 using the RNG or through another predetermined method.

In some embodiments, the multi-compartment carousel 702 may rotate the same number of compartments 704 (e.g., 2 compartments, 3 compartments, etc.) during each rotation. In some embodiments, the control system 104 may randomize the number of compartments 704 that the multi-compartment carousel 702 rotates through each time it rotates.

After the at least one card is removed in action 1210, the card intake area 202 may rotate at least 180° such that the opposite lateral edge of the unshuffled cards is facing the multi-compartment carousel 702, as represented in action 1208'. After the card intake area 202 is rotated in action 1208', the pick-off rollers 610 may remove at least one card from the card intake area 202, as represented in action 1210'. The removed card may be transported through the first card feed system 402 and be inserted into a compartment 704 of the multi-compartment carousel 702, as represented in actions 1212 and 1214. The multi-compartment carousel 702 may continue to rotate as described above and represented in 1216. This process may continue to repeat until there are no more cards in the card intake area 202, until a preselected is reached, or until the operator enters a command to stop the process. Such a process performed by the control system 104 of the card-handling device 100 may enable an operator to randomize (e.g., intermittently alter, sporadically alter) which lateral edge of the cards is presented on one side of a stack (e.g., deck(s)) of cards.

The ejector 904 may eject the cards from the compartments 704 of the multi-compartment carousel 702 into the card transfer system 902, as represented in action 1218. The card transfer system 902 may transfer the card to the card outlet 204, as represented in action 1220. The cards may be inserted into the card outlet 204 with major faces of the cards aligned at least partially in a substantially vertical plane (e.g., transverse to the top surface 108 of the card-handling device 100, where the stack of cards is tipped over primarily extending in a horizontal or lateral plane). In some embodiments, the card outlet 204 may be positioned above the top surface 108 of the card-handling device 100. In some embodiments, the card outlet 204 may elevate and retract similar to the card intake area 202. For example, the card outlet 204 may be in a retracted position when the cards are inserted into the card outlet 204 in action 1220. In some embodiments, the card outlet 204 may be elevated above the top surface 108 of the card-handling device 100 when the card outlet 204 is full to facilitate access to the shuffled cards 205 by the operator. In some embodiments, the card outlet 204 may elevate once a specified number of cards are inserted into the card outlet 204. In some embodiments, the card outlet 204 may remain in the retracted position until the operator enters a command into the control system 104 to call the card outlet 204 to the area above the top surface 108 of the card-handling device 100.

Figure 15:
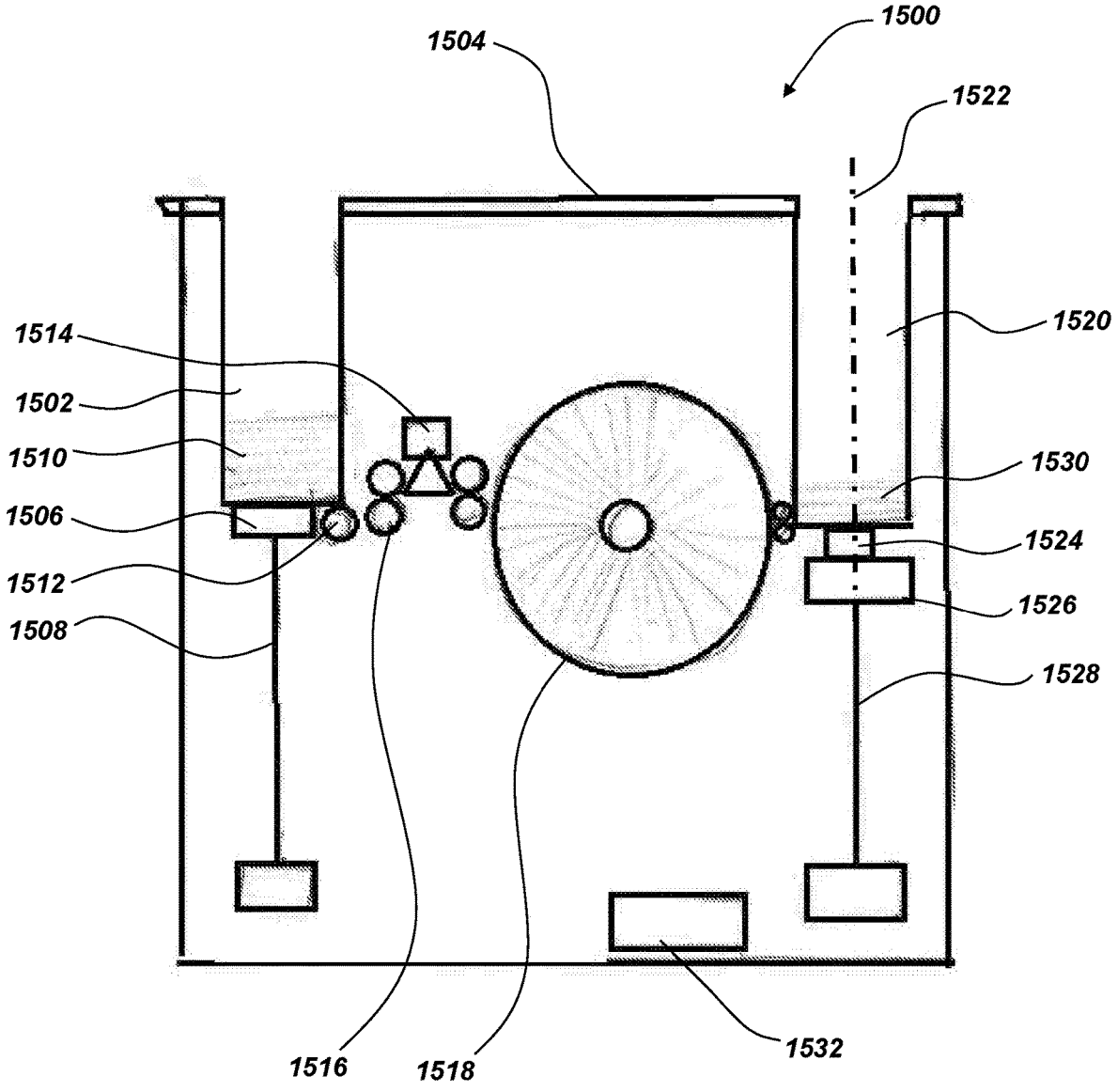
FIG. 15 shows an elevational side view of an embodiment of the present disclosure with covers removed to show the internal mechanism.

FIG. 15 shows another embodiment of a card-handling device 1500. In this embodiment, a card infeed area 1502 in a first position is located above the top surface 1504 (not shown) and in a second position is lowered below the top surface by an elevator 1506. The elevator may move the card infeed area 1502 along a path 1508 substantially parallel with side walls of the card infeed area 1502. During card loading, the card infeed area 1502 is elevated, while during shuffling, the card infeed area 1502 is in the lowered position.

In the lower position, cards 1510 in the card infeed area come into contact with a first feed roller 1512. First feed roller 1512 may move cards individually from the bottom of the stack of cards 1510, past a card-imaging device 1514 and into speed-up roller pairs 1516. The speed up roller pairs 1516 transfer cards into a compartment in the carousel 1518, which is constructed in accordance with FIGS. 9 and 10. The carousel 1518 may rotate to randomly align each compartment to the speed-up roller pairs 1516 during shuffling. As groups of cards are removed from compartments, the card sets (of one or more cards) may be transferred into card output area 1520, forming a shuffled card set.

In some embodiments, other portions of the card-handling device 1500 may be configured to change an orientation of the edges of the cards, in addition to or alternative from, the card infeed area 1502. For example, the card infeed area 1502 may not rotate about the minor axis 25 of the card (shown in FIG. 1) and card output area 1520 may be configured to rotate about a rotational axis 1522 by a drive mechanism 1524, which may be a gear driven by a motor. The card output area 1520 may be lowered as the shuffled card sets are loaded by an elevator 1526. The elevator 1526 may move linearly along a path 1528 substantially aligned with rotational axis 1522 of the card output area 1520 in two different directions. During card unloading, the elevator may move down (e.g., in a direction into an interior area of the card-handling device 1500) and during card delivery the card output area 1520 may move up (e.g., in a direction toward the top surface 1504 of the card-handling device 1500). During carousel unloading, a stack of cards 1530 may begin to accumulate in the card output area 1520. The card output area 1520 may be rotated approximately 180 degrees per rotation. The rotations may be determined, for example, according to a fixed pattern, according to an algorithm or randomly to reorient lateral edges of groups of cards as the cards are unloaded from the carousel 1518. The manner in which cards are loaded and/or unloaded from the carousel may be substantially identical to the manner in which cards are moved in the other embodiments.

In some embodiments, the cards 1530 may be rotated in batches, according to at least one predetermined formula or algorithm. For example, the card output area 1520 may rotate and receive at least one card from the carousel 1518, then rotate and receive four cards from the carousel 1518, and repeat. In another example, ten cards may be received by the card output area 1520 before the card output area 1520 rotates. The card-handling device 1500 may include a processor 1532 that has an associated random number generator hardware component or algorithm that determines when the card output area 1520 rotates relative to the packs of cards being delivered.

Figure 16:
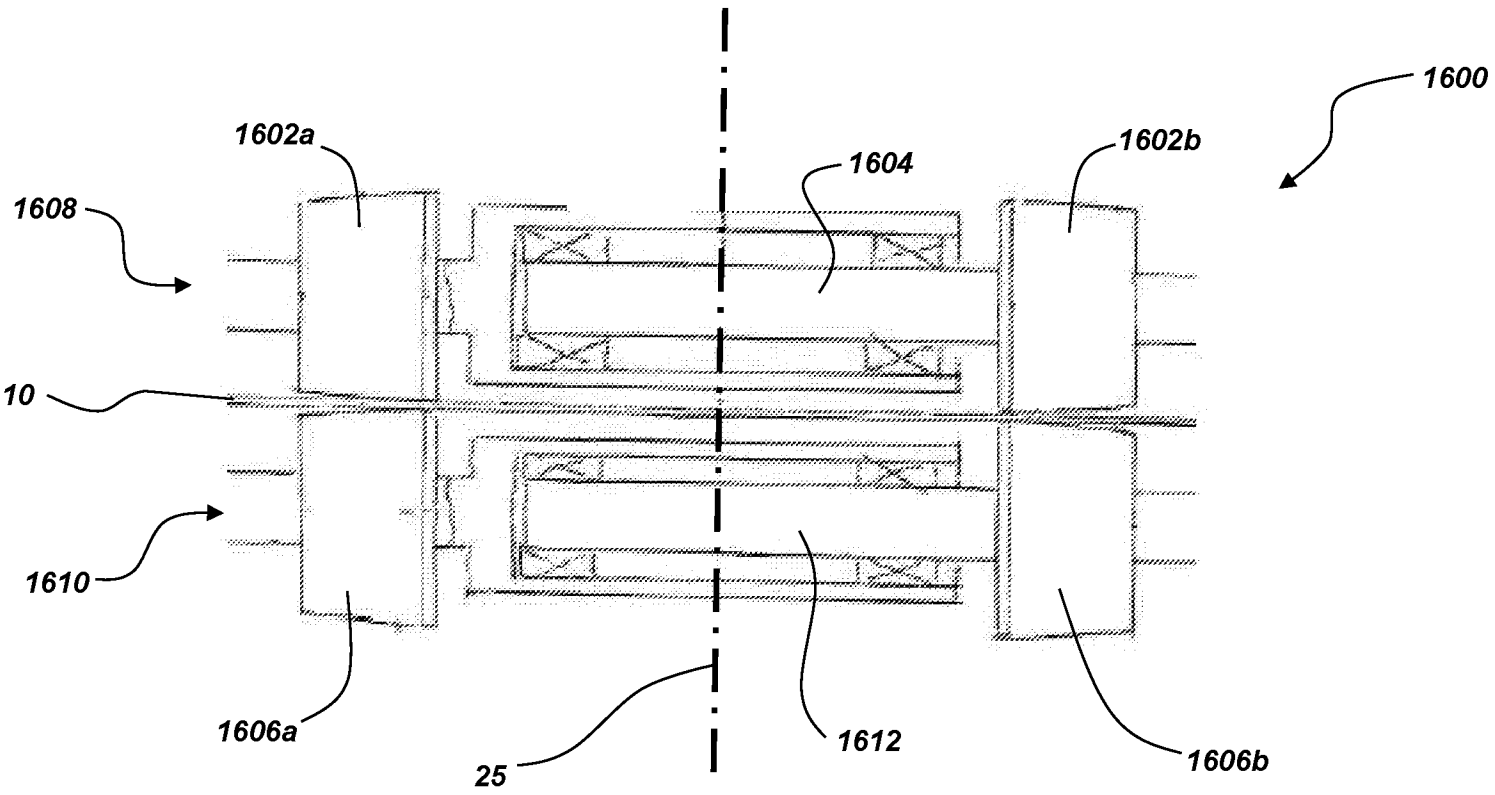
FIG. 16 shows an enlarged view of a roller set from an elevational front view.

FIG. 16 illustrates an enlarged front view of a roller set 1600. The roller set 1600 may be positioned in a card-handling device (e.g., card-handling devices 100, 1500) between the card infeed area 1502 and the card output area 1520. For example, the roller set 1600 may be positioned proximate or may replace the speed-up roller pairs 1516 (FIG. 15) positioned between the card infeed area 1502 and the carousel 1518. In another example, the roller set 1600 may be positioned between the carousel 1518 and the card output area 1520, for example, where cards are unloaded one at a time from the carousel 1518 or another type or randomization device.

The roller set 1600 may include a primary roller 1608 and a secondary roller 1610. The primary roller 1608 may include a first wheel 1602*a* and a second wheel 1602*b* separated by a shaft 1604. The secondary roller 1610 may include a first wheel 1606*a* and a second wheel 1606*b* separated by a shaft 1612. In some embodiments, the first wheels 1602*a*, 1606*a* and the second wheels 1602*b*, 1606*b* may be configured to move independently. For example, when receiving a card 10 into the roller set 1600 or transporting the card 10 from the roller set 1600, the first wheels 1602*a*, 1606*a* and the second wheels 1602*b*, 1606*b* may move in substantially the same direction such that the card 10 moves along a substantially straight path into or out of the roller set 1600. The roller set 1600 may be configured to rotate the card 10 about the minor axis 25 of the card 10. When rotating the card 10 the first wheels 1602*a*, 1606*a* may rotate in a direction opposite the rotation of the second wheels 1602*b*, 1606*b* such that the card 10 rotates about the minor axis 25. In some embodiments, the one or more first wheels 1602*a*, 1606*a* or the second wheels 1602*b*, 1606*b* may be driven (e.g., by a motor) during rotation of the card 10 while the other set of wheels are not driven (e.g., rotate freely).

The roller set 1600 may be configured to rotate the card 10 in increments of 180°, such as 0°, 180°, 360°, etc. In some embodiments, the roller set 1600 may selectively rotate the cards 10 about the minor axis 25. For example, the roller set 1600 may rotate every other card 10 about the minor axis 25 before transporting the cards 10 out of the roller set 1600. In some embodiments, the cards 10 may be rotated randomly. For example, a random number selector (e.g., random number generator) in the form of a program, algorithm, circuit, etc., may generate a random number and the roller set 1600 may rotate each card until the random number of cards are rotated. Once the random number of cards have been rotated, a new random number may be generated and the roller set 1600 may pass a number of cards 10 through the roller set 1600 that matches the new random number without rotating the cards 10. In some embodiments, the playing cards may be rotated pseudo-randomly. For example, a program, algorithm, or circuit may be configured to output different numbers in a preconceived series or pattern. A new number may be output each time the previous number of cards 10 passes through the roller set 1600 and the roller set 1600 may switch from rotating each card 10 to not rotating each card 10 or vice versa for each new number.

In some embodiments, the cards 10 may be rotated in batches, according to at least one predetermined formula or algorithm. For example, the roller set 1600 may rotate at least one card, and then pass four cards 10 through the roller set 1600 without rotating the cards 10, and repeat. In another example, the roller set 1600 may rotate three cards, then allow ten cards to pass through the roller set 1600 without being rotated, and repeat.

Methods of restoring the face orientation of cards back to the normal "face-to-back" orientation in a set of shuffled cards are disclosed. In some embodiments, the disclosed methods provide the operator with the opportunity to reorient cards that were either placed into the card infeed area of the shuffler in the flipped over orientation, or reorients cards that may have flipped over internal to the shuffler after card feeding. Although house procedures require the dealer to reorient the cards face-down before depositing the cards in the discard rack or into the card infeed area of the shuffler, cards are frequently reinserted into the shuffler in the wrong face orientation. Card inserted with the wrong face orientation may cause delays or errors in an automatic shuffler. For example, as described above, an automatic card shuffler may be configured to read and/or recognize cards to verify that a shuffled set of cards is complete (e.g., there are not extra or fewer cards in the set). A card inserted in the wrong face orientation may cause the automatic shuffler to alert the dealer through an error message or to abort the entire shuffle resulting in a delay for the associated gaming table. In some embodiments, cards may be inserted in the card infeed area face-down and any cards in the stack that are face-up may be detected and handled such that the shuffling can be completed without restarting the entire shuffle.

Cards may be received in the card infeed area of a card shuffler as a set, preferably with a majority of cards in a normal face-to-back orientation with an adjacent card. If any card or cards are in a face-to-face orientation in the card intake area of the shuffler, prior to methods of the present disclosure, the shuffle is at risk of being aborted or otherwise being ineffective.

Even when the dealer orients all of the card faces in the same direction, the cards can still reorient inside of the card shuffler. For example, properly oriented cards may flip over during card handling internal to the machine.

When a card face is in the wrong orientation, i.e., a flipped card is read by the card reader, the camera may image the card back instead of the card front causing a misread condition. In some examples, the card recognition system may be incapable of reading the card. In other examples, the card recognition system may be configured to read the card back and generate a signal that causes the processor to issue a signal indicating that a card back has been sensed (e.g., instead of the card face), indicating a flipped card condition. In both examples, the card recognition system fails to read a card face and generates a signal of this condition.

In the embodiments of the shuffling structures described above, cards move substantially horizontally, face down, along a card path from the card intake into the card-shuffling mechanism. Before insertion into a shuffling mechanism, such as a compartment of a carousel in a carousel-type shuffler, the card face may be read by a camera imaging system located along the card path. When a card face is flipped over, the card back is imaged instead, causing the processor to recognize the condition of a failure to read a card face. For example, the card recognition system may be trained to identify only rank and suit values and any card that lacks these features is identified as requiring special handling. For example, jokers may require special handling in a game that does not utilize jokers, such as blackjack. In some embodiments, flipped cards may be treated as special cards, sorted out, and presented to a dealer such that the dealer may manually remove them from an end of the shuffled set.

Figure 17:
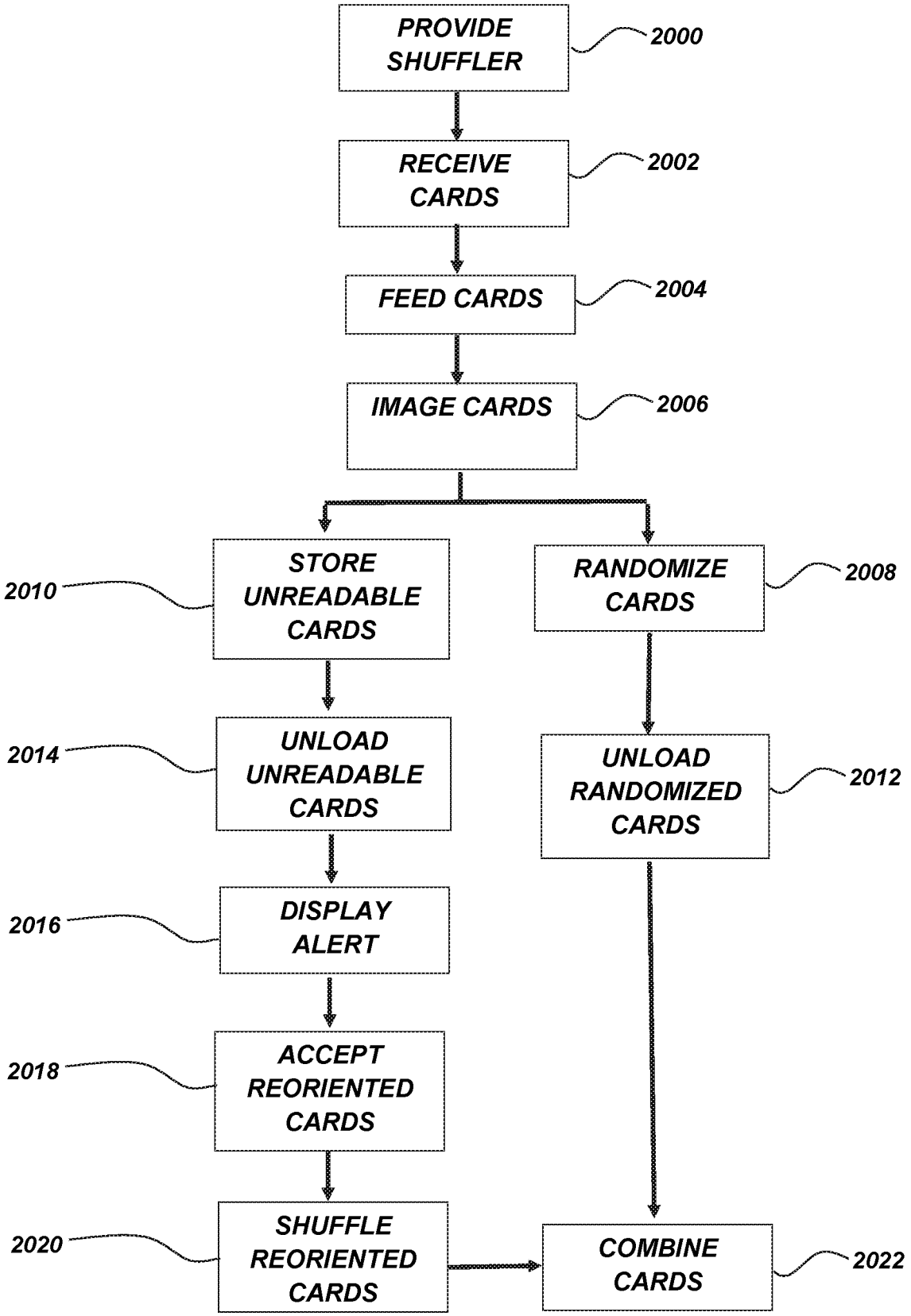
FIG. 17 is a process flow diagram showing an example of a flipped card detection and recovery routine.

FIG. 17 is a process flow diagram illustrating acts of an exemplary method of altering a face orientation of cards being shuffled in an automatic card shuffler is illustrated. The method comprises the act of providing an automatic card shuffler at operation 2000. The exemplary shuffler may include a user display, a card intake, a card outlet, a card-shuffling apparatus, a card path between the card intake and the card output, a card-imaging system, and a processor for controlling the card-imaging system, the user display and an operation of the card shuffler, such as the embodiments described above with respect to FIGS. 3 through 12 and 15. In some embodiments, the card-shuffling apparatus may include multiple compartments, wherein at least one compartment is designated for receiving cards that the imaging system has identified as lacking card face information. In some embodiments, card face information may include conventional rank and suit symbols, conventional rank or suit symbols or a special marking indicating rank and suit, or a special marking indicating rank or suit value. Examples of special markings include infrared (IR) ink markings, nano markings, barcode markings, encrypted codes, unencrypted codes, and the like.

For purposes of this disclosure, card-imaging systems that are capable of reading a card back, or a card-imaging system that is incapable of reading a card back are referred to as a card-imaging system that failed to read card face data. Cards that were not recognized as having card face markings for purposes of this disclosure are unimaged cards. These cards can be flipped cards, cut cards, promotional cards, jokers, and/or any other cards that do not belong in the card set.

In some embodiments, a plurality of cards may be received in the card intake area of a card shuffler at operation 2002. The card shuffler may be configured to shuffle cards. The shuffler may operate as a batch shuffler or a continuous shuffler. The cards inputted for shuffling may be arranged in a stack, such as a vertical stack with card faces located in horizontal planes. In other examples, the stack may be horizontal, with card faces located in vertical planes. Alternatively, the stack may be tipped with respect to the vertical slightly to stabilize the stack. The cards are generally arranged face-to-back, but there may be one or more cards in the stack that are oriented in a face-to-face orientation with an adjacent card. In other words, in the process of gathering cards from the gaming table, the dealer may fail to reorient all cards face-down before inserting the cards into a discard rack or into the card intake area of the shuffler.

Each card may be individually fed from the stack into the card shuffler automatically at operation 2004. For example, cards may be individually fed from one end of the stack, such as from the bottom of the stack when the stack of card is vertical. In some embodiments, cards may be removed with blades from the center of the stack. The blades may randomly select a location in the stack to eject the card.

At operation 2006, cards may be imaged. An example of a suitable card-imaging device is described in detail above. The cards may be imaged in the card infeed area, along the card path or if cards are moved out of the shuffling apparatus individually, between the shuffling apparatus and the card output area.

Card face information may be read at operation 2006 by the card-imaging system. In some embodiments, at least a portion of a card face of each card is read as the card is being fed into the shuffling apparatus. In some embodiments, cards are read between the card infeed area and the card-shuffling mechanism from an elevation beneath a horizontal card path. In other embodiments, the bottom card is read while in the stationary position in the card infeed area. In some embodiments, card faces are oriented face-down on the card path, and cards are read as they move. In other embodiments, cards are read before movement, or are caused to pause at a card reading station and are imaged when the card is stationary.

Cards may move individually along the card path after imaging and may then be shuffled at operation 2008 by a card-shuffling apparatus.

For example, at operation 2008, cards that have recognizable card face information may be inserted into randomly or pseudo-randomly selected compartments in the card-shuffling apparatus. In one example, cards may be fed individually into a compartment of a shuffling carousel. A compartment may be first randomly or pseudo-randomly selected by the processor and aligned with a stationary card feed mechanism in order to receive a card. In some embodiments, cards may move horizontally into a radial compartment aligned with a horizontally disposed card feeder, the compartment being part of a carousel shuffling mechanism, such as the structure described more fully above. The carousel may be configured to rotate about horizontal axis and may be driven with a drive mechanism such as a stepper motor. The particulars of an exemplary card-shuffling mechanism are described above.

As described above, when a card face is not recognized by the card-imaging system, indicating at a minimum that there is a problem with a card, the processor directs the card-shuffling mechanism to handle that card differently as compared to the other cards being shuffled. At operation 2010, cards that are unimaged may be inserted into one or more designated compartments in the carousel. In contrast, all cards that were read (and recognized) to identify at least one of rank or suit may be handled in a manner such that the cards are randomly or pseudo-randomly shuffled at operation 2008. For example, under processor control, all readable cards may be randomly inserted into randomly selected compartments until a maximum number of cards has been reached in the randomly selected compartment. When the compartment reaches its maximum, the full compartment may be excluded from the next random selection process. In some embodiments, when all cards in the card input area have been randomly or pseudo-randomly distributed to a compartment, the card-shuffling apparatus may begin a card unloading process by moving groups of imaged cards from the compartments into a card output area as shown in operation 2012. The unloading process can be done randomly or sequentially. Sequential unloading causes the shuffling operation to be performed at a faster speed as opposed to using randomly selected compartment unloading procedures. Random unloading, on the other hand increases randomness.

All readable, randomized cards may be unloaded into the card outlet. In some embodiments, a stack of shuffled cards may be formed in the card outlet, with each card in the stack in a face-to-back orientation. In some embodiments, the stack may be substantially horizontal with card faces in a substantially vertical plane. In other embodiments, the stack may be substantially vertical with the card faces in a substantially horizontal plane.

At the end of the card distribution process, if any unreadable cards are present in a designed compartment of the shuffling mechanism, those cards may be unloaded last at operation 2014 from the at least one designated compartment and combined with the set of cards in the card output. In other embodiments, the unreadable cards may be reoriented prior to any shuffling and then shuffled along with the entire set of cards once reoriented.

The processor may direct the display to issue a warning or an alert at operation 2016 that there are cards in the card output that have not been examined. If the cards are flipped over, the processor may direct the display to instruct the operator to reorient the cards and reinsert them into the card input area.

Any cards delivered to the card output area should be examined to determine if they are cut cards, flipped cards or extraneous cards. The dealer may then remove any cards that do not belong in the deck, reorient the flipped cards and activate the shuffler to re-feed the cards. At operation 2018, the reoriented cards are accepted in the card infeed area of the shuffler. The shuffler may then shuffle the reoriented cards at operation 2020. Shuffled cards are then combined at operation 2022 with the set of shuffled cards in the card output to form a complete set of shuffled cards in card face-to-back orientation.

At operation 2014, when unimaged cards are combined in the card output, a horizontal stack of shuffled cards may be formed with card faces aligned in a vertical plane and the flipped cards may be added to one end of the stack. When the stack of cards is elevated and exposed to the dealer, the dealer can visually observe that the cards on the end of the stack are flipped over or are not part of the set. In other examples, the shuffled stack may be vertical, with card faces in a horizontal plane, and the dealer must remove the flipped and/or wrong cards after the bottom of the set is exposed.

When unreadable cards or cards that lack card face data are sensed at operation 2006, the processor may cause the user display to display an alert at operation 2016 that there are cards in the wrong card face orientation in the card outlet that require manual reorientation, or that there are unknown cards in the shuffler, or both. In some embodiments, the processor may delay the display of the alert and/or instruction until the unloading cycle begins, until the unloading cycle ends or during unloading. In other embodiments, the instruction may be delayed until the flipped cards or unknown cards are physically delivered to the card output. The processor may further cause the display to display an instruction for the user to manually reorient the face of the flipped card or cards, and optionally to press a button to reactivate the shuffler.

In some embodiments, one or more manually reoriented cards may be accepted back in the card intake, wherein the reoriented cards are positioned in the correct face orientation for card imaging. Accepted cards may then be automatically fed from the card intake into the card shuffler. The activation of the shuffling process may be by user input or it may occur when the device senses cards accepted in the card input area. The reoriented cards may be shuffled, and the shuffled cards unloaded into the card outlet and combined with the incomplete shuffled set of cards in the card output to form a complete set of shuffled cards, each card having a card face-to-back orientation with an adjacent card. Cards that are fed into the shuffler in the wrong face orientation or cards that flipped over internal to the card shuffler may be reoriented and separately randomized after reorientation without aborting the entire shuffle. Avoiding the long process of reshuffling may save the casino valuable time and prevent revenue loss by reducing the time needed to shuffle a large set of cards.

The specific structures that may be used as examples of structures to perform the methods of the present disclosure are described fully above. For example, the card-shuffling mechanism may comprise a carousel with multiple radial compartments and the carousel may be oriented to rotate about an axis that is horizontal. Card moving rollers that extend through an opening in the base of the card infeed area may enable movement of individual cards from the bottom of a stack of cards into additional roller pairs that move cards along a card path. Cards may be advanced to a pair of feed rollers that accelerate a card into an aligned compartment in the carousel. A packer arm may apply a force to the trailing edge of the card, causing the card to move into the compartment. A processor may include a random number generator and the alignment of each compartment with the stationary card feed rollers may be done according to a randomly selected compartment as determined by the random number generator. A second card mover may be used to remove a card or cards from a selected compartment into a card output. Additional feed rollers may be provided to propel groups of cards along a card path to the card output. The card output may be equipped with a device to expand the volume of the card receiving area as cards are unloaded into the card output. The card unloading process may be performed during card loading or after the card loading process has been completed.

In some embodiments, a card-shuffling apparatus with a multi-compartment carousel is uses to change the order of cards. Each compartment is radially aligned and may be configured to accept one or more cards. For example, each compartment may be configured to hold between 1 and 10 cards, 1 and 7 cards, or 1 and 6 cards.

In some embodiments, the card shuffler may accept a vertical stack of cards, and structures are provided to feed cards fed individually from the bottom of the vertical stack, along a card path in a face-down orientation. When the cards are fed face-down, it may be advantageous to provide a card reading system beneath the card path in an orientation where the system is able to capture rank and suit information, card face information, or any other information printed on the card face, such as infrared markings, bar code markings or any other markings capable of designating card rank, card suit, manufacturer, lot number, casino name, card game, or any other information included on the card face whether readable or not readable by the naked eye.

Shuffled cards may be stacked in a substantially horizontal stack, with card faces in a substantially vertical plane. This stack may be formed in a container proximate the playing surface, or below the playing surface and then elevated by means of an elevator to the playing surface. Structures used to practice the present disclosure may be configured to shuffle as many as 8-10 decks of playing cards, such as 10 intermixed decks of cards, with our without jokers, with or without special cards, with or without additional cards added and with or without specific cards removed. For example, according to the present method, a set of 10 Spanish decks of cards may be shuffled and flipped cards reoriented according to embodiments of the present disclosure.

The embodiments of the present disclosure may facilitate implementation and practice of card games using larger numbers of cards than is conventionally possible without undesirably delaying game play. For example, the embodiments of the present disclosure may allow for the card games using more than eight decks of cards, such as, for example, ten decks of cards, or twelve decks of cards. Embodiments of the card-handling devices may also facilitate simple repair and replacement of wear parts of the card-handling device, such as, for example, compartment modules of the multi-compartment carousel, roller, imaging devices, and sensors by enabling access to these components that can be removed (e.g., where select groups of compartments of the carousel may be individually removed and repaired or replaced).

The embodiments of the present disclosure may reduce and/or eliminate the effectiveness of some forms of card manipulating or counting. For example, embodiments of the present disclosure may reduce or eliminate the effectiveness of card manipulating or counting methods involving edge sorting by randomizing the orientation of the lateral edges of the cards within the card-handling device. Further, the ability of the card-handling device may enable the use of more decks and thus reduce and/or eliminate the effectiveness of some forms of card manipulating or counting. Similarly, increasing the number of cards in a cut may also reduce and/or eliminate the effectiveness of some forms of card manipulating or counting.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

A list of example embodiments follows below.

Embodiment 1: A method of altering an orientation of cards being shuffled in an automatic card shuffler, comprising: providing an automatic card shuffler with a user display; a card intake, a card outlet, a card-shuffling apparatus, a card path between the card intake and the card output, a card-imaging system, at least one processor configured to control the card-imaging system, the user display, and to operate the card shuffler, wherein the card-shuffling apparatus comprises multiple compartments; receiving a plurality of cards in the card intake, the cards arranged in a stack wherein cards are generally arranged with card faces in a face to back orientation; automatically feeding each card individually from the stack along the card path and inserting the card into one of the multiple compartments of the card-shuffling apparatus; reading card face information of each card as the card is being fed with the card-imaging system; identifying unreadable cards, wherein unreadable cards include cards that lack card face information from the card-imaging system; inserting the unreadable cards into at least one designated compartment in the card-shuffling apparatus; randomly inserting each card not identified as unreadable into a randomly selected compartment; unloading all cards except the cards in the at least one designed compartment into the card outlet, forming a stack of cards, wherein each card in the stack of cards is oriented in the face-to-back orientation; unloading the unreadable cards from the at least one designated compartment and adding the unreadable cards to the stack after unloading all other cards; causing the user display to display an alert indicating that at least one card in the outlet requires at least one of inspection or reorientation; accepting at least one reoriented card from the card output in the card intake; automatically feeding each card of the at least one reoriented card in the card intake into the card shuffler; unloading the at least one reoriented card in the card shuffler to the card outlet; and combining the at least one reoriented card with the stack of cards in the card outlet to form a shuffled set of cards in the face-to-back orientation.

Embodiment 2: The method of Embodiment 1, further comprising feeding at least some of the plurality of cards into the card-shuffling apparatus comprising a carousel with a plurality of radially aligned compartments configured to receive more than one card.

Embodiment 3: The method of Embodiment 1, further comprising individually feeding the plurality of cards along a card path in a face-down orientation.

Embodiment 4: The method of Embodiment 1, further comprising stacking at least some of the plurality of cards in a substantially horizontal stack, with card faces in a substantially vertical plane.

Embodiment 5: The method of Embodiment 1, further comprising shuffling between 8 and 10 decks of cards with the card-shuffling apparatus.

Embodiment 6: A card-handling device comprising: a card intake configured to receive playing cards; a card output configured to provide at least one of the playing cards; a playing card-shuffling apparatus positioned along a card path through the card-handling and configured to randomize at least some of the playing cards, the playing card-shuffling apparatus comprising multiple compartments; and a card-imaging system positioned along the card path and configured to image a surface of the playing cards; wherein the card-imaging system is configured to recognize card face information and identify one or more unreadable playing cards, wherein the one or more unreadable playing cards comprise playing cards that do not include card face information on the surface of the playing cards oriented toward the card-imaging system; wherein the playing card-shuffling apparatus is configured to receive the one or more unreadable playing cards in at least one designated compartment selected from the multiple compartments.

Embodiment 7: The card-handling device of Embodiment 6, wherein the card-handling device is configured to provide the one or more unreadable playing cards for reorientation.

Embodiment 8: The card-handling device of Embodiment 7, wherein the card-handling device is configured to combine the one or more unreadable playing cards with the remaining playing cards after reorientation.

Embodiment 9: The card-handling device of Embodiment 6, wherein the card-handling device is configured to shuffle the playing cards that are not designated as the one or more unreadable playing cards.

Embodiment 10: The card-handling device of Embodiment 9, wherein the card-handling device is configured to combine the one or more unreadable playing cards with the shuffled playing cards after the one or more unreadable playing cards have been reoriented.

Embodiment 11: The card-handling device of Embodiment 6, wherein the playing card-shuffling apparatus comprises a carousel and the multiple compartments are oriented radially about the carousel.

Embodiment 12: The card-handling device of Embodiment 6, further comprising at least one processor configured to control operation of the playing card-shuffling apparatus and the card-imaging system.

Embodiment 13: The card-handling device of Embodiment 6, further comprising a display configured to alert a user when the unreadable playing cards are detected.

What is claimed is:

1. A card-handling device comprising:

a card intake configured to receive a plurality of playing cards;

a card output configured to provide at least one playing card of the plurality of playing cards;

a playing card-shuffling apparatus positioned along a card path through the card-handling device and configured to randomize at least some playing cards of the plurality of playing cards; and a card rotation device configured to rotate at least one playing card of the plurality of playing cards about a minor axis of the plurality of playing cards to randomly alter an orientation of lateral edges of the plurality of playing cards, the minor axis of the plurality of playing cards extending through a thickness of the at least one playing card of the plurality of playing cards in a direction transverse to a longitudinal axis and a lateral axis thereof, wherein, based on rotation by the card rotation device, a first subset of the plurality of playing cards has a first card orientation of lateral edges about the minor axis and a second subset of the plurality of playing cards has a second card orientation of lateral edges about the minor axis, the first subset and the second subset intermixed as a single set of playing cards by the card rotation device.

2. The card-handling device of claim 1, wherein a location of the card rotation device within the card-handling device is selected from the group consisting of the card intake, the card output, or along the card path between the card intake and the card output.

3. The card-handling device of claim 1, wherein one of the card intake or the card output comprises the card rotation device.

4. The card-handling device of claim 1, wherein each playing card of the plurality of playing cards comprises a first lateral edge and a second, parallel and opposing lateral edge, and the card-handling device is configured to position the card rotation device in a first orientation with the first lateral edges of the plurality of playing cards facing the playing card-shuffling apparatus and a second orientation with the second, parallel and opposing lateral edges of the plurality of playing cards facing the playing card-shuffling apparatus.

5. The card-handling device of claim 1, wherein the card path is partially defined by a series of rollers.

6. The card-handling device of claim 5, wherein the card rotation device comprises at least two rollers of the series of rollers, wherein the at least two rollers are configured to each contact a surface of a playing card of the plurality of playing cards as the playing card passes through the card rotation device and rotate the at least two rollers in opposing directions causing the playing card to rotate about the minor axis of the playing card.

7. The card-handling device of claim 1, wherein the card rotation device is configured to receive the plurality of playing cards after the plurality of playing cards have been randomized by the playing card-shuffling apparatus.

8. The card-handling device of claim 1, wherein the card rotation device is controlled by an algorithm configured to initiate rotation of the card rotation device 180 degrees after a specified interval.

9. The card-handling device of claim 8, wherein the algorithm is configured to change the specified interval after each rotation.

10. The card-handling device of claim 8, wherein the algorithm is configured to retain the specified interval at a same value after each rotation.

11. The card-handling device of claim 8, wherein the specified interval is a number of playing cards between 1 playing card and 10 playing cards.

12. A card-handling device comprising:

a card intake configured to receive a plurality of playing cards;

a card output configured to provide at least one playing card of the plurality of playing cards; and a card rotation device positioned in at least one location selected from the group consisting of the card intake, the card output, or along a card path between the card intake and the card output and configured to rotate at least one playing card of the plurality of playing cards about a minor axis of the plurality of playing cards to randomly alter an orientation of one or more lateral edges of the plurality of playing cards, the minor axis of the plurality of playing cards extending through a thickness of the plurality of playing cards in a direction transverse to a longitudinal axis and a lateral axis of the plurality of playing cards, wherein, based on rotation by the card rotation device, a first subset of the plurality of playing cards has a first card orientation of lateral edges about the minor axis and a second subset of the plurality of playing cards has a second card orientation of lateral edges about the minor axis, the first subset and the second subset intermixed as a single set of playing cards by the card rotation device.

13. The card-handling device of claim 12, further comprising a playing card-shuffling apparatus positioned along the card path between the card intake and the card output and configured to randomize at least some playing cards of the plurality of playing cards.

14. The card-handling device of claim 13, further comprising a card-imaging device positioned along the card path between the card intake and the playing card-shuffling apparatus.

15. A card-handling device comprising:

a card intake configured to receive a plurality of playing cards;

a card output configured to provide at least one playing card of the plurality of playing cards; and a card rotation device configured to rotate at least one playing card of the plurality of playing cards about a minor axis of the plurality of playing cards to randomly alter an orientation of lateral edges of the plurality of playing cards, the minor axis of the plurality of playing cards extending through a thickness of the at least one playing card of the plurality of playing cards in a direction transverse to a longitudinal axis and a lateral axis thereof, wherein, based on rotation by the card rotation device, a first subset of the plurality of playing cards has a first card orientation of lateral edges about the minor axis and a second subset of the plurality of playing cards has a second card orientation of lateral edges about the minor axis, the first subset and the second subset intermixed as a single set of playing cards by the card rotation device.

16. The card-handling device of claim 15, wherein the card rotation device comprises at least two rollers positioned along a path of the one or more playing cards between the card intake and the card output, wherein the at least two rollers are configured to each contact a surface of a playing card of the plurality of playing cards as the playing card passes through the card rotation device and rotate the at least two rollers in opposing directions causing the playing card to rotate about the minor axis of the playing card.

17. The card-handling device of claim 15, wherein the card output comprises an elevator configured to move one or more playing cards of the plurality of playing cards along a linear path.

18. The card-handling device of claim 15, wherein the card output is the card rotation device.

19. The card-handling device of claim 18, wherein the card output is configured to rotate 180 degrees after a specified number of playing cards are received by the card output.

20. The card-handling device of claim 15, wherein the card intake is the card rotation device.

* * * * *